US012270198B2

(12) United States Patent
deNourie

(10) Patent No.: US 12,270,198 B2
(45) Date of Patent: Apr. 8, 2025

(54) BUILDING CONSTRUCTION

(71) Applicant: Herbert L. deNourie, Omaha, NE (US)

(72) Inventor: Herbert L. deNourie, Omaha, NE (US)

( * ) Notice: Subject to any disclaimer, the term of this patent is extended or adjusted under 35 U.S.C. 154(b) by 0 days.

(21) Appl. No.: 18/600,925

(22) Filed: Mar. 11, 2024

(65) Prior Publication Data

US 2024/0279921 A1 Aug. 22, 2024

Related U.S. Application Data

(62) Division of application No. 17/532,975, filed on Nov. 22, 2021, now Pat. No. 11,959,272.

(60) Provisional application No. 63/118,294, filed on Nov. 25, 2020.

(51) Int. Cl.
*E04B 1/80* (2006.01)
*E04B 1/76* (2006.01)

(52) U.S. Cl.
CPC ..... *E04B 1/806* (2013.01); *E04B 1/7662* (2013.01); *E04B 2001/7691* (2013.01)

(58) Field of Classification Search
CPC ..... E04B 2001/7691; E04C 2/08; E04C 2/24; E04C 2/243; E04C 2/26; E04C 2/284; E04C 2/292
See application file for complete search history.

(56) References Cited

U.S. PATENT DOCUMENTS 246,626 A 9/1881 Morse
1,522,708 A 1/1925 Andrews
1,651,539 A 12/1927 Olson
1,757,479 A 5/1930 Ernst et al.
1,800,150 A 4/1931 Leslie et al.
(Continued)

FOREIGN PATENT DOCUMENTS

CN 103711208 A 4/2014
EP 0919673 A2 6/1999
(Continued)

OTHER PUBLICATIONS

Ionescu, "The historical evolution of the energy efficient buildings", in Renewable and Sustainable Energy Reviews, vol. 49, Apr. 24, 2015, pp. 243-253.
(Continued)

*Primary Examiner* — Jessica L Laux
(74) *Attorney, Agent, or Firm* — Outside General Counsel LLP; Peter Gordon

(57) ABSTRACT

A wall construction, or other opaque structure of a building, includes a sequence of highly reflective insulation elements that block heat energy exchange across air spaces, combined with material insulation supporting a heat energy highly reflective surface of the highly reflective insulation element. A highly reflective insulation element is formed by enclosing an air space between surfaces, of which one or both of those surfaces is a heat energy highly reflective surface. The heat energy highly reflective surface can be provided by a layer applied to a material. In an opaque building structure, two or more such highly reflective insulation elements, using three or more heat energy highly reflective surfaces, and two or more air spaces, where the material supporting at least one of the heat energy highly reflective surfaces is a material insulator, can improve energy efficiency.

20 Claims, 10 Drawing Sheets

(56) References Cited

U.S. PATENT DOCUMENTS 1,890,418 A 12/1932 Krnst
1,906,510 A 5/1933 Baluf et al.
1,934,174 A 11/1933 Eduard
1,954,582 A 4/1934 Aschenbrener
1,963,609 A 6/1934 Balduf et al.
2,015,817 A 10/1935 Ernst
2,045,733 A 6/1936 Spafford
2,054,694 A 9/1936 Eldredge
2,101,836 A 12/1937 Benedict
2,172,048 A 9/1939 Johnson
2,189,409 A 2/1940 Sibley
2,235,681 A 3/1941 Haven et al.
2,251,585 A 8/1941 Finck
2,312,301 A 3/1943 Channing et al.
2,312,987 A 3/1943 Grassick
2,332,287 A 10/1943 Philip
2,488,548 A 11/1949 Maccracken
2,502,575 A 4/1950 Raphael
2,559,869 A 7/1951 Gay
2,569,234 A 9/1951 Finck
2,595,905 A 5/1952 Maria
2,643,000 A 6/1953 Morrison
2,643,022 A 6/1953 Cornell
2,750,313 A 6/1956 Schwartz et al.
2,777,786 A 1/1957 Schwartz et al.
2,786,004 A 3/1957 Schwartz et al.
2,879,554 A 3/1959 Wheeler
2,911,759 A 11/1959 Pilkington et al.
3,001,473 A 9/1961 Shepheard
3,007,596 A 11/1961 Matsch
3,018,016 A 1/1962 Huilicka
3,027,608 A 4/1962 Ryan
3,043,112 A 7/1962 Head
3,069,301 A 12/1962 Buckley et al.
3,192,575 A 7/1965 Rosenau et al.
3,231,986 A 2/1966 Touton
3,239,144 A 3/1966 Holger
3,616,139 A * 10/1971 Jones ..... B32B 15/12 428/117
3,641,724 A 2/1972 Palmer
3,769,770 A 11/1973 Deschamps et al.
3,832,992 A 9/1974 Trombe et al.
3,948,295 A 4/1976 Lemont et al.
3,952,947 A 4/1976 Saunders
4,004,389 A 1/1977 DiFazio
4,021,895 A 5/1977 Morse et al.
4,051,891 A 10/1977 Harrison
4,074,482 A 2/1978 Klahr
4,108,373 A 8/1978 Chiapale et al.
4,143,197 A 3/1979 Jasionowicz et al.
4,143,815 A 3/1979 Meysenburg
4,161,087 A 7/1979 Levesque
4,251,598 A * 2/1981 Waite ..... E04B 1/806 428/603
4,271,826 A 6/1981 Duchene
4,286,576 A 9/1981 McClelland
4,300,322 A 11/1981 Clark
4,335,166 A 6/1982 Lizardo et al.
4,337,990 A 7/1982 Fan et al.
4,368,226 A 1/1983 Mucaria
4,433,019 A 2/1984 Chumbley
4,459,789 A 7/1984 Ford
4,462,883 A 7/1984 Hart
4,478,018 A 10/1984 Holand
4,479,018 A 10/1984 Van
4,510,726 A 4/1985 MacDonald
4,532,917 A 8/1985 Taff et al.
4,550,046 A 10/1985 Miller
4,663,908 A 5/1987 Kestel
4,674,253 A 6/1987 Young
4,777,086 A 10/1988 Madden et al.
4,780,164 A 10/1988 Rueckheim et al.
4,782,889 A 11/1988 Bourne
4,799,745 A 1/1989 Meyer et al.
4,815,245 A 3/1989 Gartner
4,824,710 A 4/1989 Dieul
4,943,484 A 7/1990 Goodman
4,974,382 A 12/1990 Avellanet
5,038,693 A 8/1991 Kourtides et al.
5,230,941 A * 7/1993 Hollander ..... B65D 81/3853 428/116
5,277,959 A 1/1994 Kourtides et al.
5,316,835 A 5/1994 Groft et al.
5,344,718 A 9/1994 Hartig et al.
5,413,864 A 5/1995 Miyazaki et al.
5,454,428 A 10/1995 Pickard et al.
5,514,476 A 5/1996 Hartig et al.
5,557,462 A 9/1996 Hartig et al.
5,570,555 A 11/1996 Ferguson et al.
5,743,330 A 4/1998 Bilotta et al.
5,765,330 A 6/1998 Richard
5,772,716 A 6/1998 Krohm et al.
5,862,854 A 1/1999 Gary
6,308,491 B1 10/2001 Porter
6,421,972 B1 7/2002 Dalphond et al.
6,797,356 B2 9/2004 Zupon et al.
7,089,995 B2 8/2006 Koscheyev et al.
7,571,578 B2 8/2009 Moody et al.
7,735,282 B2 6/2010 Price
8,082,916 B2 12/2011 Colson
8,256,690 B2 9/2012 Newberry
8,276,337 B2 10/2012 Plini
8,635,824 B2 1/2014 Scherrer
8,806,824 B2 8/2014 Schwan
9,103,113 B2 8/2015 Lockhart
9,140,064 B2 9/2015 Guthrie
9,163,397 B2 10/2015 Willson et al.
9,404,673 B2 8/2016 Swift et al.
9,469,984 B2 10/2016 Miks et al.
9,677,264 B2 6/2017 Iverson
9,783,980 B2 10/2017 Snyder et al.
9,783,985 B2 10/2017 Iverson
9,957,715 B1 * 5/2018 Carlson ..... E04C 2/296
10,024,551 B2 7/2018 Lin
10,533,331 B2 1/2020 McDonagh
10,626,608 B2 4/2020 Lambach et al.
10,731,332 B1 8/2020 Iverson
10,773,882 B2 9/2020 Scherrer et al.
11,959,272 B1 4/2024 Denourie
2003/0061777 A1 4/2003 Alderman
2004/0000112 A1 1/2004 Alderman
2004/0000113 A1 1/2004 Alderman
2004/0005450 A1 1/2004 Aanestad
2004/0250490 A1 12/2004 Hall
2005/0055982 A1 3/2005 Medina
2009/0313930 A1 12/2009 Anderson et al.
2010/0236172 A1 9/2010 Wirth
2011/0146171 A1 6/2011 Flatland
2011/0239573 A1 10/2011 Lockhart
2014/0115991 A1 5/2014 Sievers et al.
2017/0138040 A1 5/2017 Groft et al.
2017/0174952 A1 6/2017 Bess et al.
2017/0247883 A1 8/2017 Iverson
2018/0066427 A1 3/2018 Snyder
2020/0190806 A1 6/2020 Johnson et al.
2020/0407972 A1 12/2020 Snyder et al.
2021/0372120 A9 12/2021 Bess et al.

FOREIGN PATENT DOCUMENTS

EP 1582649 B2 8/2010
EP 1783289 A3 1/2011
EP 2314787 B1 6/2012
EP 1939374 B1 6/2013
EP 2366845 B1 6/2013
FR 2861365 A1 4/2005
FR 2893134 A1 5/2007
FR 2982523 B1 1/2014
GB 1064812 A 4/1967
GB 2134444 A 8/1984
GB 2398758 B 4/2006
GB 2451183 A 1/2009

(56) References Cited

FOREIGN PATENT DOCUMENTS

| | | | |
|---|---|---|---|
| GB | 2496739 | B | 4/2014 |
| WO | 2007107767 | A1 | 9/2007 |
| WO | 2007143782 | A1 | 12/2007 |

OTHER PUBLICATIONS

Iordache, et al., "Permeability measurements of apssive house during two construction stages", in Energy Procedia 85, 2016, pp. 279-287.
Johansson, et al., "Climate Conscious Architecture and Urban Design in Jordan—towards energy efficient buildings and improved urban microclimate", (Report; vol. 12). Housing Development & Management, Lund University, 2009, 118 Pages.
John, et al., "Modeled and Measured Drainage, Storage and Drying Behind Cladding System", Building Science Research Report 0905, Sep. 15, 2009, 21 Pages.
Johnson, et al., "M.I.T. Solar Building 5: The Second Year's Performance", Dept. of Energy report DOE/CS/34513-1., Nov. 1979, 101 Pages.
Kenisarin, "Short-Term Storage of Solar Energy. 1. Low Temperature Phase-Change Materials", Applied Solar Energy (Geliotekhnika), vol. 29, No. 2, pp. 48-65., 1993, 18 Pages.
Kernagis, "Passive House Takes Root in the United States", in Home Energy (now Building Performance Journal), 2008, pp. 26-28.
Kesik, "Cost Effective Levels of Thermal Insulation for Basements in Canadian Housing", in Proceedings 11th Canadian Conference on Building Science and Technology, 2007, 12 Pages.
Kesik, "Moisture Management Strategies", in Whole Building Design Guide, (available at: https:// wbdg.org/resources/moisture-management-strategies), Aug. 16, 2016, 17 Pages.
Kosny, et al., "How the Same Wall Can Have Several Different R-Values: Relations Between Amount of Framing and Overall Thermal Performance in Wood and Steel-Framed Walls", in Proceedings of Ashrae Therm X, 2007, 9 Pages.
Kosny, et al., "PCM-enhanced Building Envelopes in Current ORNL Research Projects", from https://phasechange.com/wp-content/uploads/2017/06/PCM-Enhanced-Building-Envelopes.pdf, Jun. 2017, 14 Pages.
Kralj, et al., "Investigations of 6-Pane Glazing: Properties and Possibilities", Energy & Buildings, vol. 190, pp. 61-68., Feb. 25, 2019, 8 Pages.
Kreider, et al., "Solar Heating and Cooling: Engineering, Practical Design, and Economics", Revised First Edition, Hemisphere Publishing Corporation, pp. 20-24., 1975, 4 Pages.
Kusuda, et al., "Fundamentals of Building Heat Transfer", Journal of Research of the National Bureau of Standards, vol. 82, No. 2, pp. 97-106,., Sep.-Oct. 1977, 10 Pages.
La Vardera, "USA new Wall—Swedish Platform Framing in Detail", from: http:// blog.lamidesign.com/2011/06/, Jun. 18, 2011, 8 Pages.
Lacasse, "Field Evaluation of Thermal and Moisture Response of Highly-Insulated Wood-frame Walls", presentation at Buildings XIII conference, Dec. 6, 2016, 25 Pages.
Latha, et al., "Role of building material in thermal comfort in tropical climates—A review", in Journal of BuildingEngineering, vol. 3, Jun. 28, 2015, pp. 104-113.
Lea, "Passive and Active Solar Retrofit on a Traditional Adobe", available at: https://greenpassivesolar.com/2013/02/passive-solar-retrofit-on-adobe/, Feb. 3, 2013, 10 Pages.
Learnmetrics, "Insulation R-Value Chart: R-Values Per Inch (for 51 Materials)", https://learnmetrics.com/insulation-r-value-chart-per-inch/, date unknown, 28 Pages.
Lemieux, et al., "Wall Systems", in Whole Building Design Guide, (available at: https://wbdg.org/guides-specifications/building-envelope-design-guide/wall-systems), May 10, 2016, 41 Pages.
Leskovsek, "Calculation of U Value", Report of Wergelandsveien project, Trimo Group, Sep. 25, 2015, 9 Pages.
Levins, et al., "Cooling Energy Measurements of Single-Family Houses With Attics Containing Radiant Barriers in Combination With R-11 and R-30 Ceiling Insulation", Oak Ridge National Laboratory, ORNL/CON-226., May 1987, 84 Pages.
Levins, et al., "Heating Energy Measurements of Single-Family Houses With Attics Containing Radiant Barriers in Combination With R-11 and R-30 Ceiling Insulation", Oak Ridge National Laboratory, ORNL/CON-239., Aug. 1988, 129 Pages.
Lstiburek, "A Crash Course in roof Venting", in Fine Homebuilding, pp. 68-72., Aug.-Sep. 2011, 5 Pages.
Lstiburek, "BSI-001: The Perfect Wall", Building Science Corporation., Jul. 15, 2010, 4 Pages.
Lstiburek, "BSI-028: Energy Flow Across Enclosures", Building Science Corporation., Dec. 1, 2009, 7 Pages.
Lstiburek, "BSI-070: First Deal With The Manure and Then Don't Suck", Building Science Corporation., Jun. 11, 2014, 7 Pages.
Lstiburek, "BSI-075: How Do Buildings Stack Ip?", Building Science Corporation., Feb. 14, 2014, 9 Pages.
Lstiburek, "BSI-096: Hot and Wet but Dry", Building Science Corporation., Jun. 13, 2016, 7 Pages.
Lstiburek, "BSI-136: Piltdown Man Does Thermal Resistance*", Building Science Corporation., Oct. 15, 2022, 10 Pages.
Lstiburek, "Buidling in Extreme Cold", Building Sciences Corporation Insight BSI-031, 2010, 5 Pages.
Lstiburek, "Five Things", Building Sciences Corporation Insight BSI-039, 2010, 5 Pages.
Lstiburek, "Forty Years of Air Barriers", Building Sciences Corporation Insight BSI-084, Feb. 2015, 9 Pages.
Lstiburek, "Joni Mitchell, Water and Walls", Building Sciences Corporation Insight BSI-071, Aug. 2013, 7 Pages.
Lstiburek, "Macbeth Does Vapor Barriers", Building Sciences Corporation Insight BSI-073, Nov. 2013, 6 Pages.
Lstiburek, "Mind the Gap, Eh!", Building Sciences Corporation Insight BSI-038, Nov. 2013, 8 Pages.
Lstiburek, "Understanding Air Barriers", Building Sciences Corporation, Building Science Digest BSD-104, Oct. 24, 2006, 26 Pages.
Lstiburek, "Understanding Walls", Building Sciences Corporation Insight BSI-120, 2013, 17 Pages.
Lstiburek, "Vitruvius Does Veneers", Building Sciences Corporation Insight BSI-086, 2015, 7 Pages.
Lstiburek, "Zeroing In", Building Sciences Corporation Insight BSI-081, Oct. 2014, 8 Pages.
Lstiburek,, "Hybrid Assemblies", Building Sciences Corporation, Insight BSI-100, Oct. 2017.
Lyons, et al., "Glazing", from Yourhome.gov.au., 2020, 22 Pages.
Macrolux USA, "Macrolux Multi Wall Polycarbonate Sheets", corporate product information, 2022, 8 Pages.
Maines, "Thermal-and Moisture-Control Layers for an Energy-Efficient House", from: https:// www.finehomebuilding.com/project-guides/insulation/prohome-wall-thermal-moisture-control-layers., date unknown., 15 Pages.
Manville, "AP™ Foil-Faced Polyisocyanurate Foam Sheathing", Product brochure, dated Mar. 2022., Mar. 2022, 4 Pages.
McKay, "It's Not Rocket Science #5: Night Sky Radiant Cooling", from https:// misfitsarchitecture.com/2013/03/01/its-not-rocket-science-5-night-sky-radiant-cooling/, Mar. 1, 2013, 13 Pages.
McKay, "It's Not Rocket Science #6: The Stack Effect", from https:// misfitsarchitecture.com/2013/03/05/its-not-rocket-science-6-the-stack-effect/, Mar. 5, 2013, 9 Pages.
McKay, "The Things Architects Do #4: Reuse, Recycle, Reprise", from https://misfitsarchitecture.com/2013/03/07/the-things-architects-do-3-reuse-recycle-reprise/, Mar. 7, 2013, 15 Pages.
Medina, "A comprehensive review of Radiant Barrier Research Including Laboratory and Field Experiments", in Ashrae Transactions, 118 Part 1, 2012, 8 Pages.
Medina, et al., "Reflecting on Heat Transfer Reduction", in The Construction Specifier, https://www.constructionspecifier.com/reflecting-on-heat-transfer-reduction/), Dec. 4, 2014, 9 Pages.
Zhang, et al., "Practical moisture buffering effect of three hygroscopic materials in real-world conditions", in Energy and Buildings, 139, 2017, pp. 214-223.

(56) References Cited

OTHER PUBLICATIONS

Zhao, et al., "Radiative sky cooling: Fundamental principles, materials, and applications", Appl. Phys. Rev. 6, 021306, Apr. 16, 2019, 41 Pages.
Bourdakis, et al., "Night time cooling by ventilation or night sky radiation combined with in-room radiant cooling panels including phase change materials", In: Proceedings of the 36th AIVC Conference: Effective ventilation in high performance buildings, Madrid, Spain, 2015, 10 Pages.
Bridge, et al., "Why do Transparent Objects Let Light Pass Through But Opaque Objects don't?", from www.quora.com., Retrieved on Feb. 22, 2023, 27 Pages.
Buckley, "One-Piece Throat System", from https://www.rumford.com/classicflyerplan.html, 2012, p. 1.
Burns, "Thickness Effect in Low-Density Insulation", NBSIR 84-2906., Aug. 1984, 52 Pages.
Carlos, et al., "Contribution of a double ventilated window to the energy efficiency of a building", In book: Advances in Energy Research, vol. 7 (pp. 273-306), Chaptert, Publisher: Nova Science Publishers, Inc, Editors: Morena J. Acosta, 2011, 35 Pages.
Carmeliet, et al., "Wetting pattern of sheathing panels in wood stud walls", in Proceedings 11th Canadian Conference on Building Science and Technology, 2007, 11 Pages.
Choa, "Super window' Could Save $10 Billion Annually in Energy Costs", from News from Berkeley Lab., Jun. 6, 2018, 5 Pages.
Co-Ex Corporation, "Macrolux Polycarbonate Multi-Wall Panels", corporate product information, 2011, 8 Pages.
Coldham, "Six Proven Ways to Build Energy Smart Walls", Fine Homebuilding, Dec. 2009/Jan. 2010, pp. 68-73.
Courville, et al., "Comparision of the Dynamic Thermal Performance of the Insulated Roof Systems", ORNL Report No. CONF-890854-1 and DE89006628, https://www.osti.gov/servlets/purl/6297318., Jan. 1989, 25 Pages.
Crowe, "Proper design of vapor retarders requires close attention to temperature", NRCA Roofing., Feb. 2005, 9 Pages.
Curcija, et al., "Triple Glazing with Thin Non-Structural Center Glass", webpage of Lawrence Berkeley National Laboratory, Windows and Daylighting, (available at: https://windows.lbl.gov/triple-glazing-thin-non-structural-center-glass), 2019, 3 Pages.
De Dear, et al., "Progress in thermal comfort research over the last twenty years", Indoor Air 2013, vol. 23, No. 6, Apr. 10, 2013, pp. 442-461.
Denzer, "Energy Efficiency and the Swedish Catalog House", Ashrae 2020 virtual conference, Paper Session 18., 2020, 32 Pages.
Designing Buildings, Ltd., "U-Values", From https://www.designingbuildings.co.uk/U-values, Dec. 13, 2021, 3 Pages.
Desjarlais, "The Thermal Performance of Reflective Insulation Materials and Systems With Horizontal Heat Flow: A parametric Study", ORNL Building IV Proceedings, available at https://web.ornl.gov/sci/ buildings/conf-archive/1989%20B4%20papers/024.pdf, 1989, pp. 271-285.
Dupont De Nemours, Inc., "DuPont Thermax Sheathing", corporate product information, 2019, 4 Pages.
Dupont De Nemours, Inc., "DuPont Thermax Wall System—Installation Procedures", corporate product information, 2021, 6 Pages.
Dupont De Nemours, Inc., "DuPont Thermax Wall System—Overview", corporate product information, 2019, 2 Pages.
Dupont De Nemours, Inc., "DuPont Tuff-R and Super Tuff-R Polyisocyanurate Insulation", corporate product information, 2019, 4 Pages.
Dupont De Nemours, Inc., "Tech Solutions 513.0 DuPont Thermax Wall System", corporate product information, 2019, 20 Pages.
Elmahdy, et al., "Assessment of the Energy Rating of Insulated Wall Assemblies—A Step Toward Building Energy Labeling", Proceedings of the Tenth international Conference for Enhanced Building Operations, Kuwait, document ESL-IC-Oct. 10, 11, Oct. 2010, 12 Pages.
Fabian, "Psychrometric Chart Use", from https://extension.psu.edu/psychrometric-chart-use., Jul. 12, 2016, 7 Pages.
Fairey, "Radiant Energy Transfer and Radiant Barrier Systems in Buildings", Florida Solar Energy Center, University of Central Florida, Publication No. FSEC-DN-6-86., 1986, 6 Pages.
Feist, "Energy Efficiency—The Global Contribution of the Passive House Standard", proceedings of SUDee2018 Workshop, Oct. 15, 2018, 17 Pages.
Feist, "The Passive House—a solution for affordable housing", Proc. 22nd International Passive House Conference, 2020, 14 Pages.
Fi-Foil Company, "High Performance Radiant Insulation Systems", Company Brochure, 2020, 12 Pages.
Fi-Foil Company, Inc., "HY-Fi Hybrid Insulation System", 2021, 4 Pages.
Fine, et al., "Analysis of Heat Transfer in Building Thermal Insulation", Oak Ridge National Laboratory (ORNL)), ORNL/TM-7481., 1980, 78 Pages.
Franco, "How to Calculate the Thermal Transmittance (U-Value) in the Envelope of a Building", ArchDaily. Accessed Jun. 7, 2023. <https://www.archdaily.com/898843/how-to-calculate-the-thermal-transmittance-u-value-in-the-envelope-of-a-building> ISSN 0719-8884., Jul. 29, 2018, 4 Pages.
Fullam, "Vented vs Unvented Roofs: What is the Best Design?", available at: https:// mechanical-hub.com/vented-vs-unvented-roofs-what-is-the-best-design/, Jun. 2, 2020, 8 Pages.
Gaham, "Understanding R-value", NRCA Roofing., Feb. 2022, 5 Pages.
García, et al., "Thermodynamic and exergoeconomic analysis of a non-domestic Passivhaus retrofit", Building and Environment (2017), doi: 10.1016/j.buildenv.2017.03.003., Mar. 2, 2017, 43 Pages.
Garden, "Thermal Considerations in Roof Design", Canadian Building Digests, CBD-70. From National Research Council Canada., Oct. 1965, 6 Pages.
Gawande, et al., "Thermal Energy Storage by Phase Change Material", in International Research Journal of Engineering and Technology, vol. 3, Issue 10, Oct. 2016, pp. 149-152.
Goncalves, et al., "Design Considerations for Curtain Wall Parapets in Cold Climates", in Proceedings 11th Canadian Conference on Building Science and Technology, 2007, 8 Pages.
Habraken, et al., "Design Methodologies for Energy Conservation and Passive Heating of Buildings Utilizing Improved Building Components", Progress Report for U.S. Energy Research and Development Administration, Apr. 1978, 13 Pages.
Hedges, et al., "Innovation in Residential Construction Systems in Sweden", Proc. 1st Residential and Building Design and Construction Conference. Pennsylvania Housing Research Center., 2013, 10 Pages.
Holladay, "A Superinsulated House from 1984", From https://www.greenbuildingadvisor.com/article/a-superinsulated-house-from-1984, Oct. 14, 2016, 2 Pages.
Holladay, "Buyer's Guide to Insulation: Rigid Foam", Fine Homebuilding, (available at https:// www.finehomebuilding.com/2012/01/24/buyers-guide-to-insulation-rigid-foam), Jan. 2012, 4 Pages.
Holladay, "Closed-cell foam between studs is a waste", Fine Homebuilding, Aug./Sep. 2017, pp. 86-89.
Holladay, "The Klingenberg Wall", from Green Building Advisor (https://www.greenbuildingadvisor.com/article/the-klingenberg-wall), Nov. 29, 2013, 3 Pages.
Hubble, "A Complete Breakdown of Exterior Wall Sheathing Options", from https:// barricadebp.com/news/exterior-wall-sheathing., Jun. 4, 2018, 5 Pages.
Huber Engineered Woods, LLC, "Zipsystem sheathing & Tape Installation Manual", corporate product information, 2018, 100 Pages.
Hunter Panels, "Hunter Panels Xci Foil", corporate product information, 2021, 2 Pages.
Hunter Panels, "Hunter Panels Xci Foil (Class A)", corporate product information, 2022, 2 Pages.
Hunter Panels, "The Hunter XCI Advantage", corporate product information, 2020, p. 1.
Hunter Panels, "Xci Foil Class A Plus", corporate product information, 2023, 2 Pages.
Hybris, "An Innovative Reflective Insulation", for Roofs, Walls and Ceilings., Retrieved on Feb. 22, 2023, 6 Pages.

(56) References Cited

OTHER PUBLICATIONS

Infra Insulation, Inc., "Infra Accordion Insulation", product brochures, circa 1950's, 2 Pages.
Melton, et al., "Spray Foam: Open-Cell vs. Closed-Cell", Johns Manville, Jun. 10, 2020, 4 Pages.
Miller, "Rumford Fireplaces are Hotter than Ever", from https://www.houzz.com/magazine/rumford-fireplaces-are-hotter-than-ever-stsetivw-vs~23073755, Feb. 16, 2014, 5 Pages.
MIT Libraries, "Solar Houses", Bibliographies for MIT Solar Houses, available at https://libguides.mit.edu/c.php?g=175920&p=1160317, 3 Pages.
MIT Libraries, "Solar Houses at MIT: Dover Sun House", 2008, 3 Pages.
MIT Libraries, "Solar Houses at MIT: Solar I", 2008, p. 1.
MIT Libraries, "Solar Houses at MIT: Solar II", 2008, p. 1.
MIT Libraries, "Solar Houses at MIT: Solar III", 2008, 2 Pages.
MIT Libraries, "Solar Houses at MIT: Solar IV", 2008, 2 Pages.
MIT Libraries, "Solar Houses at MIT: Solar V", 2008, p. 1.
Moreno, "Industrialization of Water Flow Glazing Facades by means of modular units", 7th Eur. Conf., ren. Energy Sys. Madrid, Spain., Jun. 10-12, 2019, 14 Pages.
Mosher, et al., "Insulation", from Yourhome.gov.au., 2020, 29 Pages.
Multiple Authors, "Rumford fireplace", from Wikipedia, https://en.wikipedia.org/wiki/Rumford_fireplace, last edited Jul. 7, 2023, accessed Sep. 20, 2023, Sep. 20, 2023, 2 Pages.
National Gypsum Company, "Gold Bond Foil Back Gypsum Board", corporate product information, copyright, 2001-2013, p. 1.
National Gypsum Company, "Gold Bond Foil Back Gypsum Board, Technical Information", corporate product information, revision Jan. 2021, 4 Pages.
Neale, et al., "Determination of surface convective heat transfer coefficients by CFD", in Proceedings 11th Canadian Conference on Building Science and Technology, 2007, 12 Pages.
Overbey, "Defining mass walls through heat capacity", Building Enclosure emagazine, (see https://www.buildingenclosureonline.com/articles/print/85698-defining-mass-walls-through-heat-capacity), Feb. 12, 2016, 3 Pages.
Paladin Industrial, "Spider Tie 5/2/3 Insulated Concrete Forming System", corporate product information, transcript of video posted on YouTube at: https://www.youtube.com/watch?v=4Di_KVqcRqw, Apr. 21, 2017, 12 Pages.
Paladin Industrial, "Spider Tie Concrete Wall Forming System—Instructions", corporate product information, 2009, 12 Pages.
Panjehpour, "Structural Insulated Panels: Past, Present, and Future", Journal of Engineering, Project, and Production Management, 2013, pp. 2-8.
Parker, et al., "NightCool: A Nocturnal Radiation Cooling Concept", Proceedings of ACEEE 2008 Summer Study on Energy Efficiency in Buildings, American Council for an Energy Efficient Economy, Washington, DC, Aug. 2008, 15 Pages.
Pennsylvania State University, "Atmospheric Controllers of Local Nighttime Temperature", from https://www.weather.gov/source/zhu/ZHU_Training_Page/winds/nighttime_influences/Nighttime_Influences.htm, 1999-2004, 7 Pages.
Pennsylvania State University, "Meteograms: Messages in Time", from https://learningweather.psu.edu/node/16, 2019, 7 Pages.
Pettit, "RR-1401: Design Challenges of the NIST Net Zero Energy Residential Test Facility", Building Science Corporation, Research Reports., Sep. 18, 2014, 13 Pages.
Plyco Corporation, "Plyfoil Data Sheet", corporate product information, 2012, p. 1.
Plyco Corporation, "Product Installation Instructions", corporate product information, Jun. 15, 1996, 2 Pages.
Ply-Foil Incorporated, "New & Improved Ply-White Double Bubble Metallized Reflective Insulation", corporate product information, 2012, 2 Pages.
Ply-Foil Incorporated, "Ply-Foil Concrete Slabe insulation", corporate product information, 2012, 2 Pages.
Ply-Foil Incorporated, "Ply-Foil Reflective Insulation Specification & Application Guide for Post Frame and Metal Building Construction", corporate product information, 2016, 12 Pages.
Pochee, et al., "New insight on passive ice making and seasonal storage of the Iranian Yakhchal and their potential for contemporary applications", in proceedings of NCEUB's PLEA 2017 Edinburgh, 2017, 8 Pages.
Pontolilo, "Crash Course in Control Layers", Fine Homebuilding, Feb./Mar. 2020, pp. 58-63.
Prodex Total Insulation, "Bubble Insulation, Bubble Wrap, Foil Only Radiant Barriers and Prodex Total—What's the Difference", corporate blog, (available at https://www.insulation4less.com/bubble-single-and-double-bubble-insulation-vs-prodex-total)., Jul. 2020, 7 Pages.
Radiant Guard (Corporate Source), "History of Radiant Barrier", corporate blog, undated, 2 Pages.
Radiant Guard (Corporate Source), "Product Selection Guide", corporate blog, undated, 3 Pages.
Radiant Guard (Corporate Source), "What is a Radiant Barrier?", corporate blog, undated, 2 Pages.
Raish, "Thermal Comfort: Designing for People", U.T. Austin, School of Architecture, Technical Report, 2009, 10 Pages.
Reardon, "Passive Cooling", Yourhome.gov.au., 2020, 21 Pages.
Reardon, et al., "Thermal Mass", Yourhome.gov.au., 2020, 16 Pages.
Rita, "Passive Cooling Techniques", slides and transcript, from https://www.slideserve.com/Rita/passive-cooling-techniques, Dec. 2011, 17 Pages.
RMAX, "Ecomaxci FR Air Barrier Exterior Wall Application (Type I-IV)", corporate product information, 2020, p. 1.
RMAX, "Evomaxci Building Envelope Solutions", corporate product information, 2016, 6 Pages.
RMAX, A Division of Sika Corp., "Ecomaxci FR (Replaces TSX-8500) Exterior Wall Application (Type I-IV)", corporate product information, 2020, p. 1.
RMAX, A Division of Sika Corp., "Rainscreen Application—Utilizing Rmax Thermasheath and Cedar Siding", corporate product information, 2020, 2 Pages.
RMAX, a Division of Sika Corp., "Thermasheath below-grade exterior wall solution", corporate product information, 2022, 6 Pages.
Robinson, et al., "The Thermal Insulating Value of Air Spaces", U.S. Dept. of Commerce, Nation Bureau of Standards Report No. 3030, Jan. 11, 1954, 68 Pages.
Robinson, "Thermal Resistance of Airspaces and Fibrous Insulations Bounded by Reflective Surfaces", U.S. Dept. of Commerce, National Bureau of Standards, Building Materials and Structures Report 151., Nov. 14, 1957, 28 Pages.
Rogers, "Reflective-Insulation and Radiant Barrier Systems", from https://homeenergy.org/show/article/id/1933 (download in 2021), Dec. 30, 2013, 9 Pages.
Rowley, et al., "Thermal Conductivity of Building Materials", University of Minnesota, Engineering Experiment Station, Bulletin No. 12., 1937, 143 Pages.
Saber, "Determining the Thermal Resistance of Enclosed Reflective Airspace", in Buildings, 13, 662, Mar. 2, 2023, 35 Pages.
Saber, et al., "Effective R-value of enclosed reflective space for different building applications", Journal of Building Physics, 43, 398-427, 2020, 30 Pages.
Saber, et al., "Thermal analysis of above-grade wall assembly with low emissivity materials and furred airspace", in Building and Environment 46, Jan. 6, 2011, pp. 1403-1414.
Saber, "Thermal Resistance of Enclosed Reflective Airspaces in Building Applications", in Proceedings of the Building Enclosure Science and Technology Conference (BEST4), 2015.
Said, "Task 2: Literature Review : Building Envelope, Heating, and Ventilating Practices and Technologies for Extreme Climates", Nation Research Council Canada Report B-1239., 2, Dec. 2006, 121 Pages.
Schad, et al., "Insulating Effect of Successive Air Spaces Bounded by Bright Metallic Surfaces", 37th Annual Meeting of the American Society of Heating and Ventilating Engineers, Paper No. 894, 1931, 16 Pages., 1930, 16 Pages.

(56) References Cited

OTHER PUBLICATIONS

Selkowitz, et al., "Breaking The 20 Year Logjam to Better Insulating Windows", Lawrence Berkeley National Laboratory, Report 10.20357/B76K5K., Sep. 2018, 23 Pages.
Selkowitz, "Themal performance of insulating window systems", Lawrence Berkeley National Lab (LBNL) report LBL-8835, 1981, as published in Ashrae Transactions, vol. 85, Part 2, Paper DE-79-5, #5, presented in 1979., Dec. 1, 1978, 25 Pages.
Sherburne, "The House of the Day After Tomorrow", MIT Technology Review., Jun. 22, 2010, 3 Pages.
Sherwood, et al., "Energy Efficiency in Light-Frame Wood Construction", U.S. Dept. Agriculture, Forest Service, Forest Products Laboratory, Research Paper FPL 317., 1979, 61 Pages.
Smith, et al., "A Brief History of Radiant Heating", Plumbing & Mechanical, Jun. 1, 2006, 5 Pages.
Soares, et al., "A review on current advances in the energy and environmental performance of buildings towards a more sustainable built environment", in Renewable & Sustainable Energy Reviews, vol.=77, 2017, pp. 845-860.
Straube, "Air Flow Control in Buildings", Building Sciences Corporation, Building Science Digest BSD-014, Oct. 15, 2007, 18 Pages.
Straube, "Can Highly Glazed Building Facades be Green", Building Sciences Corporation, Building Science Digest BSD-006, Sep. 11, 2008, 12 Pages.
Straube, "The Perfect HVAC", Building Sciences Corporation, Insight-022, Building Science Digest BSD-022, Jun. 2011, 5 Pages.
Straube, "Thermal Control in Buildings", Building Sciences Corporation, Building Science Digest BSD-011, Dec. 12, 2011, 12 Pages.
Taylor, "Designing with Polyiso", in GAF building science blog, available at https:// www.gaf.com/en-us/blog/designing-with-polyiso-281474980064941, Dec. 30, 2020, 9 Pages.
Taylor, "Optimizing Thermal Resistance and Inertia in Low-Slope Roof Design", Building Science (blog of GAF), (available at: https://www.gaf.com/en- us/blog/optimizing-thermal-resistance-and-inertia-in-low-slope-roof-design-281474980081878), Mar. 17, 2021, 5 Pages.
The Dow Chemical Company, "Sturdy-R Insulation", corporate product information, 2002, 2 Pages.
The Dow Chemical Company, "Thermax Heavy Duty Insulation", corporate product information, 2015, 2 Pages.
The Dow Chemical Company, "Thermax Light Duty Insulation", corporate product information, 2015, 2 Pages.
The Dow Chemical Company, "Thermax Sheathing", corporate product information, 2017, 2 Pages.
Thomas, "Heat Gains and Losses: Roofs and Walls", Lesson, Course 1, Energy Models online courses, (https://energy-models.com/heat-gains-and-losses-roofs-and-walls.), 2010, 10 Pages.
Trus, "Balloon und Platform Framing Details", 2001, 6 Pages.
U.S. Patent and Trademark Office, "Corrected Notice of Allowability", U.S. Appl. No. 17/532,975, filed Feb. 14, 2024, 3 Pages.
U.S. Patent and Trademark Office, "Corrected Notice of Allowability", U.S. Appl. No. 17/532,975, Jan. 16, 2024, 3 Pages.
U.S. Patent and Trademark Office, "Non Final Office Action Received", U.S. Appl. No. 17/532,975, Jun. 7, 2022, 7 Pages.
U.S. Patent and Trademark Office, "Notice of Allowance Received", U.S. Appl. No. 17/532,975, Nov. 25, 2022, 6 Pages.
U.S. Patent and Trademark Office, "Notice of Allowance Received", U.S. Appl. No. 17/532,975, Mar. 10, 2023, 6 Pages.
U.S. Patent and Trademark Office, "Notice of Allowance Received", U.S. Appl. No. 17/532,975, Dec. 12, 2023, 6 Pages.
U.S. Patent and Trademark Office, "Notice of Allowance Received", U.S. Appl. No. 17/532,975, Jun. 26, 2023, 6 Pages.
U.S. Patent and Trademark Office, "Restriction Requirement Received", U.S. Appl. No. 17/532,975, Mar. 18, 2022, 8 Pages.
Ueno, "Residential Exterior Wall Superinsulation Retrofit Details and Analysis", in Proceedings of the Thermal Performance of the Exterior Envelopes of Whole Buildings XI International Conference, Dec. 2010, 16 Pages.
Van Hooff, et al., "Reprint of: On the predicted effectiveness of climate adaptation measures for residential buildings.", Building and Environment, 83, https://doi.org/10.1016/j.buildenv.2014.10.006., pp. 142-158.
Vitro Architectural Glass, "How Low-E Glass Works", from https://glassed.vitroglazings.com/topics/how-low-e-glass-works, 7 Pages.
Vitro Architectural Glass., "Design Considerations with Low-E Coated Glass", Glass Technical Document TD-131, 2016, 3 Pages.
Ward, "Ozone Depletion Explains Global Warming", Current Physical Chemistry, vol. 6, 2016, pp. 275-296.
Watson, "Bioclimatic Design bioclimatic design. Encyclopedia of Sustainability Science and Technology", 893-920. https://doi.org/10.1007/978-1-4419-0851-3_225, 2012, 30 Pages.
Wikipedia, "Herbert and Katherine Jacobs First House", Retrieved from https://en.wikipedia.org/w/index.phptitle=Herbert_and_Katherine_Jacobs_First_House&oldid=1135801490, Various dates 2013-2023, 5 Pages.
Wikipedia, "Herbert and Katherine Jacobs Second House", Retrieved from https://en.wikipedia.org/w/index.php?title=Herbert_and_Katherine_Jacobs_Second_House&oldid=1158352702, Vaious dates 2009-2023, 6 Pages.
Wilkes, "Reflective Insulation", Industrial and Engineering Chemistry, vol. 31, No. 7, pp. 832-838., 1939, 7 Pages.
Wilkinson, et al., "Understanding Vapour Permeance and Condensation in Wall Assemblies", in Proceedings 11th Canadian Conference on Building Science and Technology, 2007, 14 Pages.
Woodford, "Heat-reflecting low-E glass", (https://www.explainthatstuff.com/how-low-e-heat-reflective-windows-work.html), Apr. 11, 2022, 8 Pages.
Wright, et al., "Climate Specific Passive Building Standards", US Doe, Jul. 2015, 88 Pages.
Yanowitz, "Wrapping an Older House with Rock Wool Insulation", from https:// www.greenbuildingadvisor.com/article/wrapping-an-older-house-with-rock-wool-insulation, May 14, 2013, 17 Pages.
Yarbrough, "Assessment of Reflective Insulations for Residential and Commercial Applications", Oak Ridge National Laboratory, ORNL/TM-889., Oct. 1983, 74 Pages.
Yarbrough, et al., "Hybrid and Reflective Insulation Assemblies for Buildings", in Journal of Power and Energy Engineering, Aug. 16, 2016, pp. 23-31.
Yarbrough, "Reflective Insulation for Residential and Commercial Applications", Construction Specifier, Sep. 2005, 6 Pages.
Yarbrough, "Turning Empty Air Space into Thermal Resistance", RIMA International, (available at https://www.rimainternational.org/wp-content/uploads/2012/09/Turning-Empty-Air-Space-into-Thermal-Resistance-R2.pdf), Aug. 2012, 4 Pages.
Yost, "First Look at Tstuds.", Green Building Advisor, accessible at https:// www.greenbuildingadvisor.com/article/petes-products-tstuds., Jul. 3, 2019, 11 Pages.
Yost, "Thin Glass to Change High-Performance Window Market", Building Green, vol. 28, Issue 2, Feb. 4, 2019, 7 Pages.
Zangheri, et al., "Passive house optimization for Southern Italy based on the 'New Passivhaus Standard'", ECEEE 2009 Summer Study, Act!Innovate!Deliver!Reducing Energy Demand Sustainably, 2009, pp. 1643-1648.
Zhang, et al., "Experimental evaluation of structural insulated panels outfitted with phase change materials", Applied Thermal Engineering, vol. 178, Sep. 2020, 8 Pages.
"20 Examples of Translucent, Opaque and Transparent", Examples Lab, Inc. (corporate author), from https:// www.exampleslab.com/20-examples-of-translucent-opaque-and-transparent/, 5 Pages, 2023.
"A Note an Ambient Temperature and Surface Temperature", Paper Thermometer Company (corporate author), 1 Page, Apr. 2021.
"Actis Hybrid Solutions and Systems", Actis (corporate author), product brochure, 20 Pages, Oct. 2019.
"Alpen Zenith Series", Alpen High Performance Products(corporate author), product brochure, 12 Pages, 2022.
"Applied Building Technology Group, LLC (ABTG)", Air Space R-Value, 41 Pages, Aug. 31, 2018.
"Applied Building Technology Group, LLC (ABTG)", Prescriptive R-Values, U-Factor equivalents, and total UA analysis, 16 Pages, Sep. 2015.

(56) References Cited

OTHER PUBLICATIONS

"Design Heat Transmission Coefficients", National Research Council Canada, Division of Building Research, Ashrae 1981 Fundamentals Handbook, Chapter 23, DBR Paper No. 1235, 33 Pages, 1981.
"Design Procedures for Passive Solar Buildings", U.S. Dept. of Defense, Military Handbook, MIL-HDBK-1003/19, 17 Pages, May 3, 1987.
"Energy Efficiency & Renewable Energy", U.S. Department of Energy, DOE/GO-102015-4569, pp. 102 and 103, 3 Pages, Apr. 2015.
"Energy History: MIT Solar House I, 1939", Yale University, web page, 4 Pages, 2023.
"Evaluation of Reflective and Non-Reflective Airspaces for Energy Code and FTC R-value Rule Compliance", Applied Building Technology Group, LLC (corporate author), ABTG Research Report No. 1601-02, 19 Pages, Jan. 14, 2021.
"Foamular® High-R CW Plus Extruded Polystyrene (XPS) Rigid Foam Insulation", Owens Corning (corporate author), product data sheet, Pub, No. 57176-M, 4 Pages, Feb. 2015.
"Heat Mirror IG", Alpen High Performance Products (corporate author), product brochure, 7 Pages, 2016.
"Heat Mirror IG product brochure", Eastman Chemical Company (corporate author), 3 Pages, 2023.
"How Does Reflective Foil Insulation Work?", Low-E UK, Ltd (corporate author), 13 Pages, Apr. 25, 2018.
"LightWeight Quad-Pane Windows", General Services Administation, GPG-048, 4 Pages, Nov. 2021.
"Moist Air—Density vs. Water Content and Temperature", Engineering ToolBox (corporate author), Available online at: https://www.engineeringtoolbox.com/density-air-d_680.html [Accessed Feb. 22, 2023], 4 Pages, Feb. 22, 2023.
"Optimal Low-E Coating Placment for Double-and Triple-Glazed IGUs", Vitro Architectural Glass, from: https:// glassed.vitroglazings.com/topics/optimal-low-e-coating-placement-for-double-and-triple-glazed-igus, 2 Pages.
"Passive Low-E Glass For Cooler Climates", Vitro (corporate author), from http://www.vitrowindowglass.com/window_glass/passive_lowe.aspx, dated 2001-2022, accessed Feb. 23, 2023, 2 Pages.
"Polyisocyanurate Insulation Manufacturers Association", Roof and wall thermal design guide: applying the prescriptive insulation standards of the 2012 i-codes, 26 Pages, 2012.
"Prescriptive R-Values", Georgia-Pacific Gypsum LLC (corporate author), 2 Pages, Feb. 2012.
"Solar Guard Reflective Insulation", Silvercote LLC (corporate author), product brochure, 2 Pages, 2019.
"Tech Solutions 513.0: Thermax Wall System", Dow Chemical Company (corporate author), Form No. 179-04503X-1210MCK, 28 Pages, Oct. 2009.
"Technical Information on Building Materials for use in the Design of Low Cost Housing", U.S. Dept. of Commerce, National Bureau of Standards, TIBM-16, 8 Pages, May 22, 1936.
"The Real Value of Resilient Construction", Portland Cement Association (corporate author), 26 Pages, May 2019.
"Thermal and Moisture Control in Insulated Assemblies-Fundamentals", National Research Council Canada, Division of Building Research, 2005 Ashrae Handbook-Fundamentals(SI), Chapter 23, 22 Pages, 2005.
"Thermal Gravimetric Analysis & Simultaneous Thermal Analysis", Thermophysical Properties Research Laboratory, Inc., (corporate author), 1 Page, Jan. 5, 2012.
"Thermal insulation for buildings—Reflective insulation products—Determination of hte declared thermal performance", British Standards Institution, BSI Standards Publication Bs En 6012:2012+A1:2015, 36 Pages, Feb. 2015.
"Thermal Metric Summary Report", Building Science Corporation (corporate author), 10 Pages, Jun. 18, 2015.
"Thermo-Ply® Blue & Thermo-Ply® Blue AMG Structural Sheathing", DrJ Engineering LLC (corporate author), Technical Evaluation Report (TER) No. 1004-02, 16 Pages, Mar. 29, 2016.
"Triple- & Quad-Pane Thin Glass", Alpen High Performance Products (corporate author), circ, 2 Pages, 2020.
"Understanding and Using Reflective Insulation, Radiant Barriers And Radiation Control Coatings", RIMA International, Third Edition, 27 Pages, Jun. 2014.
"Yorkshire Building Services (Whitwell) Ltd., (aka "YBS Insulation")", Foil-Tec VCL, corporate product information, 11 Pages, 2012.
"Yorkshire Building Services (Whitwell) Ltd., (aka "YBS Insulation")", SuperQuilt Technical Data Sheet, corporate product information, 28 Pages, 2020.
Actis Insulation Ltd., "Actis Triso-Super 10+", corporate product information, 8 Pages, 2017.
Albatayneh, et al., "The Significance of Building Design for the Climate", Environmental and Climate Technologies, vol. 22, pp. 165-178, 2018.
Allen, "Chapter 9: Controlling the Radiation of Heat", in How Buildings Work, Third Edition, Oxford University Press, 12 Pages, 2005.
Alpen High Performance Products, "WinSert High Performance Window Inserts", corporate product information, 2 Pages, 2022.
Anonymous, "Atmospheric Pressure", in Encyclopedia Brittanica online, undated, from https:// kids.britannica.com/students/article/atmospheric-pressure/604037, p. 1.
Anonymous, "Effect of radiation on perceived temperature", retrieved from "https://en.wikipedia.org/w/index.php?title=Effect_of adiation_on_perceived_temperature&oldid=1022296110", last edited date: May 9, 2021, 2 Pages.
Anonymous, "Roof Battens, All You Need to Know About Roofing Battens", 7 Pages.
Anonymous, "The Physics of Foil", from https://osb.westfraser.com/wp-content/uploads/2017/05/The-Physics-of-Foil.pdf, 6 Pages, Oct. 14, 2010.
Anonymous, "Thermal Performance of Windows, Doors and Shading Devices—Detailed Calculations", ISO TC 163, ISO/DIS 15099, 71 Pages, Jan. 12, 2000.
Atlas Roofing Corporation, "EnergyShield Pro Continuous Wall Insulation", corporate product information, 2 Pages, 2019.
Ayesha, "How Does Aluminum Foil Absorb or Reflect Heat?", All Things Aluminum, 6 Pages, Sep. 9, 2021.
Badea, et al., "A life-cycle cost analysis of the passive house "Politehnica" from Bucharest", Energy and Buildings, vol. 80, pp. 542-555, Apr. 23, 2014.
Bahrami, "Radiation Heat Transfer", Chapter 12, E&CE 309, Spring, 20 Pages, 2005.
Banionis, et al., "Determination of thermal resistance of reflective insulation product according LST EN 16012:2012 +A1:2015 and LST EN ISO 8990:1999", Test Report No. 141-1-1 SF/17 U, from Kaunas University of Technology, Laboratory of Building Physics, 5 Pages, Sep. 8, 2017.
Bomberg, et al., "On Slowing Climate Change with Ecological, Thermo-Active Building Systems", in Global Journal of Human-Social Science, vol. 22, Issue 4, Version 1.0, 15 Pages, 2022.
Bonilauri, "Insulation Materials: Discovering The Lambda Value", from emu.systems, 9 Pages, Feb. 29, 2016.

* cited by examiner

Legend:
RI1 = First Highly Reflective Insulation Element
RI2 = Second Highly Reflective Insulation Element
RI3 = Third Highly Reflective Insulation Element
(each is a combined airspace and adjacent surfaces, of which at least one surface is a heat energy highly reflective surface, e.g., foil face)

Legend:
RI1 = First Highly Reflective Insulation Element
RI2+3 = Second and Third Highly Reflective Insulation Elements
RI4 = Fourth Highly Reflective Insulation Element
(each is a combined airspace and adjacent surfaces, of which at least one surface is a heat energy highly reflective surface, e.g., foil face)

BUILDING CONSTRUCTION

CROSS-REFERENCE TO RELATED APPLICATIONS

This application is a continuation of U.S. patent application Ser. No. 17/532,975, filed Nov. 22, 2021, entitled "Building Construction", which is a nonprovisional patent application of, and which claims the benefit under 35 USC § 119 to, prior filed U.S. provisional patent application Ser. No. 63/118,294, entitled "Building Construction", filed Nov. 25, 2020, hereby incorporated by reference.

BACKGROUND

Materials and methods for constructing buildings generally take into consideration many factors, such as structure, cost of materials, ease of construction, utilities, and energy efficiency for heating and cooling. For residential construction in North America, wood frames are commonly used in buildings. Walls generally are constructed using a frame of studs, to which a sheathing and siding typically is applied on the exterior, and wallboard or other kind of surface typically is applied on the interior side. Contained air spaces between studs and wall surface materials typically are used for running electrical, telephony, computer networking, and other utilities. To provide better energy efficiency for heating and cooling, the primary solution used in modern wood-framed residential construction is to place material insulation in contained air spaces where needed. In metal-framed construction, continuous material insulation generally is applied outside the sheathing layer. Open air spaces with ventilation also are typical with brick-clad and other types of facades to drain moisture accumulation within a wall or other structure.

SUMMARY

This Summary introduces a selection of concepts in simplified form that are described further below in the Detailed Description. This Summary neither identifies key or essential features, nor limits the scope, of the claimed subject matter.

Instead of focusing solely on material insulation as a solution for energy efficiency, a wall construction, or other opaque structure of a building, can include a sequence of highly reflective insulation elements that block heat energy exchange across air spaces, combined with material insulation supporting a heat energy highly reflective surface of the highly reflective insulation element. A highly reflective insulation element is formed by enclosing an air space between surfaces, of which one or both of those surfaces is a heat energy highly reflective surface. The heat energy highly reflective surface can be provided by a layer applied to a material. In an opaque building structure, two or more such highly reflective insulation elements, using three or more heat energy highly reflective surfaces, and two or more air spaces, where the material supporting at least one of the heat energy highly reflective surfaces is a material insulator, can improve energy efficiency.

For example, a wall construction of a building typically includes a plurality of studs that support exterior and interior walls. A sequence of highly reflective insulation elements including at least one material insulator supporting at least one of its heat energy highly reflective surfaces, is formed in the space between the exterior and interior walls and between a pair of studs. Similar structures can be formed within other kinds of framing for a wall or for other opaque building structures, such as ceiling, floor, roof, attic, crawl-space, or basement, or other opaque building structure that forms part of an enclosed living space.

As another example, a device can be made for insertion into the space between exterior and interior walls, or other opaque building structures, and within the framing supporting those structures. The device, when so installed, forms such a sequence of highly reflective insulation elements including at least one material insulator supporting at least one of its heat energy highly reflective surfaces. As an example, such a device can include a pair of material insulators enclosing an air gap, where the opposing surfaces of each material insulator has a heat energy highly reflective surface. Thus, the air gap enclosed by the material insulators is enclosed within two heat energy highly reflective surfaces. When the device is inserted within the space within a wall, with air spaces on either side, the result is a sequence of highly reflective insulation elements, including with two material insulators.

Having two or more enclosed air gaps with heat energy highly reflective layers provides a tandem series of heat energy exchanges across air space elements which supports energy efficient heating and cooling of the space enclosed by walls or other opaque structures of such construction. Different constructions can be used depending on the climate, the building construction, and whether living space is heated, cooled, or ambient, as the number of air spaces and heat energy highly reflective surfaces used depends on the direction of heat transfer in different weather seasons.

In one aspect, an apparatus in an opaque building structure includes a tandem series of highly reflective insulation elements, each highly reflective insulation element comprising one or more parallel heat energy highly reflective surfaces enclosing an air gap. A material insulation element supports at least one of the heat energy highly reflective surfaces of at least one of the highly reflective insulation elements.

In one aspect, a device for use in an opaque building structure includes a first material insulation element having a first surface and a second surface opposite the first surface, wherein the first surface is a first heat energy highly reflective surface, and wherein the second surface is a second heat energy highly reflective surface. The device further includes a second material insulation element having a third surface and a fourth surface opposite the third surface, wherein the third surface is a third heat energy highly reflective surface, and wherein the fourth surface is a fourth heat energy highly reflective surface. The first material insulation element and the second material insulation element are connected to form an air gap between the second surface and the third surface, whereby the air gap, the second surface, and the third surface form a highly reflective insulation element.

In one aspect, an opaque building structure includes framing, and an exterior structure attached to the framing, the exterior structure having an exterior inner surface, and an interior structure attached to the framing, the interior structure having an interior inner surface. Between the exterior structure and the interior structure, a tandem series of highly reflective insulation elements are attached to the framing, each highly reflective insulation element comprising one or more parallel heat energy highly reflective surfaces enclosing an air gap, and parallel with the exterior inner surface and the interior inner surface, and a material insulation element supporting at least one of the heat energy highly reflective surfaces of at least one of the highly reflective insulation elements.

In another aspect, an opaque building structure includes framing, a device attached to the framing, an exterior structure attached to the framing, and an interior structure attached to the framing. The device includes a first material insulation element having a first surface and a second surface opposite the first surface. The first surface is a first heat energy highly reflective surface. The second surface is a second heat energy highly reflective surface. The device further includes a second material insulation element having a third surface and a fourth surface opposite the third surface. The third surface is a third heat energy highly reflective surface. The fourth surface is a fourth heat energy highly reflective surface. The first material insulation element and the second material insulation element are connected to form a first air gap between the second surface and the third surface, whereby the first air gap, the second surface, and the third surface form a first highly reflective insulation element. The exterior structure has an exterior inner surface parallel to and facing and forming a second air gap with the first surface of the first material insulation element. The interior structure has an interior inner surface parallel to and facing and forming a third air gap with the fourth surface of the second material insulation element. The exterior inner surface, second air gap, and first surface form a second highly reflective insulation element. The interior inner surface, third air gap, and fourth surface form a third highly reflective insulation element.

In any of the foregoing the material insulation element can have a first surface supporting the at least one of the heat energy highly reflective surfaces of the at least one of the highly reflective insulation elements, and a second surface opposite the first surface support another of the heat energy highly reflective surfaces of another of the highly reflective insulation elements.

Any of the foregoing can include one or more of the following features. The heat energy highly reflective surfaces have an emittance of less than or equal to 0.05. The heat energy highly reflective surfaces have an emittance of less than or equal to 0.04. The heat energy highly reflective surfaces have an emittance of about 0.03. The heat energy highly reflective surfaces are provided by a layer of highly reflective foil. The heat energy highly reflective surfaces are provided by a layer of metal foil. The heat energy highly reflective surfaces are provided by a layer of aluminum foil.

Any of the foregoing can include one or more of the following features. the material insulation element has a resistance factor of greater than about R-3.6 per inch. The material insulation element has a resistance factor of at least R-3.6 per inch. The material insulation element has a resistance factor in the range of R-3.6 per inch to R-8.0 per inch. The material insulation element can include rigid foam board insulation.

The following Detailed Description references the accompanying drawings which form a part this application, and which show, by way of illustration, specific example implementations. Other implementations may be made without departing from the scope of the disclosure.

Figure 1:
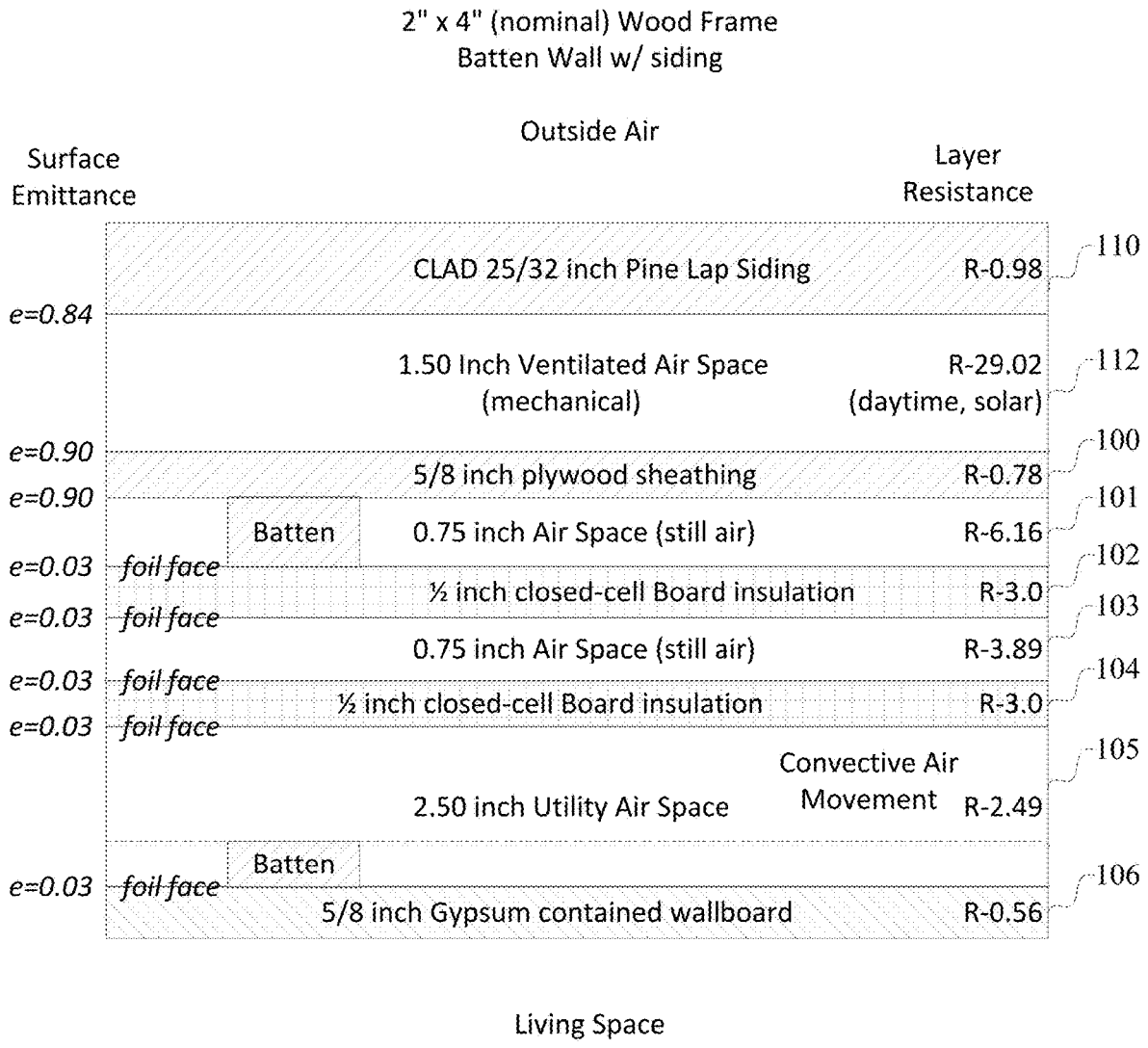
FIG. 1 is a schematic drawing of an example implementation of a wall structure.

The structures shown in the drawings are generally shown as cross-section, top-down views of the structures and are not intended to be to scale.

DETAILED DESCRIPTION

FIGS. 6A to 6H illustrate schematic diagrams of example implementations. Not shown in these schematics are studs or other framing of the wall or other building structure in which the illustrated structures can be placed. Similar constructions can be applied between a pair of studs or other framing for any other opaque building structure, such as ceiling, floor, roof, attic, crawlspace, or basement, or other opaque building structure that forms part of an enclosed living space.

Figure 6A:
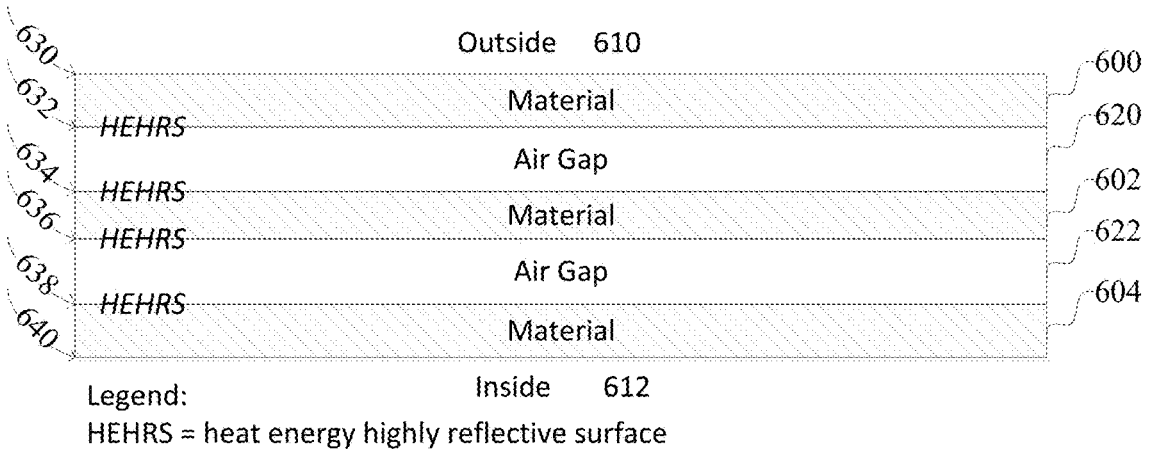
FIGS. 6A through 6H are schematic drawings of example structures.
Figure 6B:
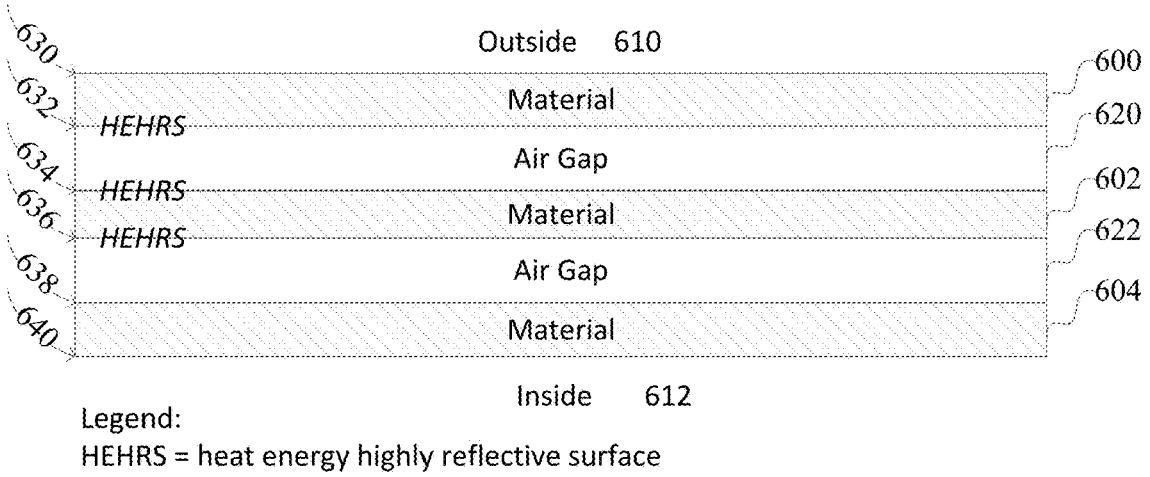
Figure 6C:
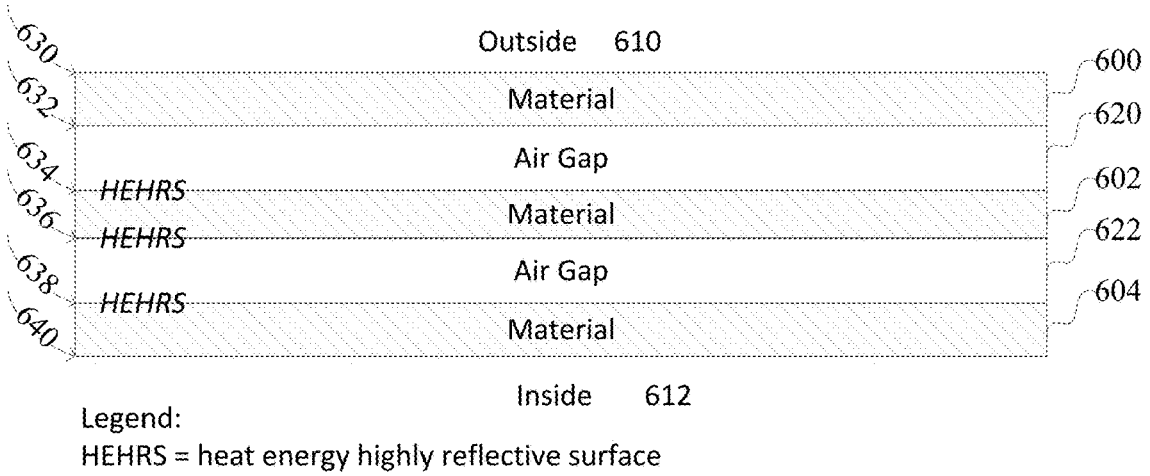

FIGS. 6A-6C illustrate a first material 600, a second material 602, and a third material 604. In some implementations, such materials can be a board such as 0.25 inch (nominally) thick plywood or fiberboard.

In some implementations, the first material 600 may form part of or may be an exterior wall, such as sheathing or panel board, such as 0.50 inch (nominally) thick plywood or fiberboard, or 0.25 inch (nominally) thick plywood or fiberboard or hardboard. In some implementations, the first material 600 may be separate from the exterior wall. In some implementations, the first material can be a combination of materials, such as a commercially available product, optionally applied to sheathing. For example, a polyurethane insulating panel, such as a PUREWALL panel from Covestro, may be used. For example, an insulation material called HYBRIS from Actis also can be used.

In some implementations, the second material can be a single material panel or sheet, a composite of multiple materials or panels of materials, or a device such as described below in connection with FIGS. 6D and 6E. In some implementations, the second material can be or can include any device that acts to restrict or even nearly eliminate continued conductive heat flow through the opaque building structure.

In some implementations, the third material 604 may form part of or may be an interior wall, such as a wallboard. In some implementations, the third material may be separate from the interior wall. The outside of a building is illustrated at 610; the inside of the building is illustrated at 612, for reference.

In FIGS. 6A-6C, between the first material 600 and the second material 602 is a first air gap 620 or first enclosed air space. Between the second material 602 and the third material 604 is a second air gap 622 or second enclosed air space.

In FIGS. 6A-6C, the first material 600 has an outer surface 630 and a first surface 632 opposite the outer surface. The second material 602 has a second surface 634 and a third surface 636 opposite the second surface. The third material 604 has an inner surface 640 and a fourth surface 638 opposite the inner surface. Thus, the first surface 632 and the second surface 634 form the first enclosed air space 620. The third surface 636 and the fourth surface 638 form the second enclosed air space 622.

On the first material 600, the first surface 632 can be a first heat energy highly reflective surface (HEHRS), as shown in FIGS. 6A and 6B. On the second material 602, the second surface 634 is a second heat energy highly reflective surface, and the third surface is a third heat energy highly reflective surface as shown in FIGS. 6A, 6B, and 6C. On the third material 604, the fourth surface 638 can be a fourth heat energy highly reflective surface, as shown in FIGS. 6A and 6C.

FIGS. 6D to 6G illustrate schematic diagrams of additional example implementations of wall constructions.

Figure 6D:
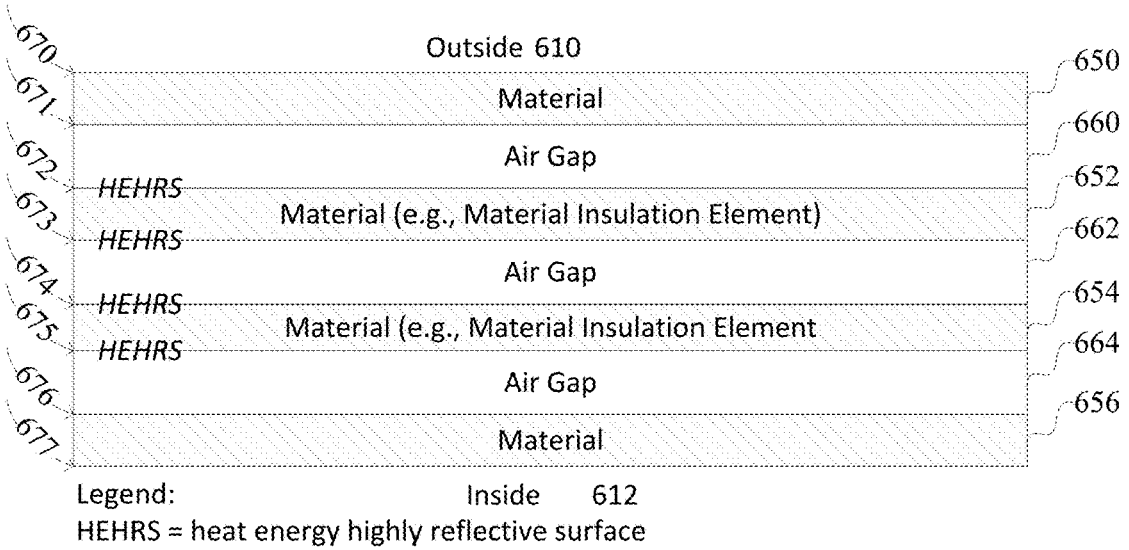
Figure 6E:
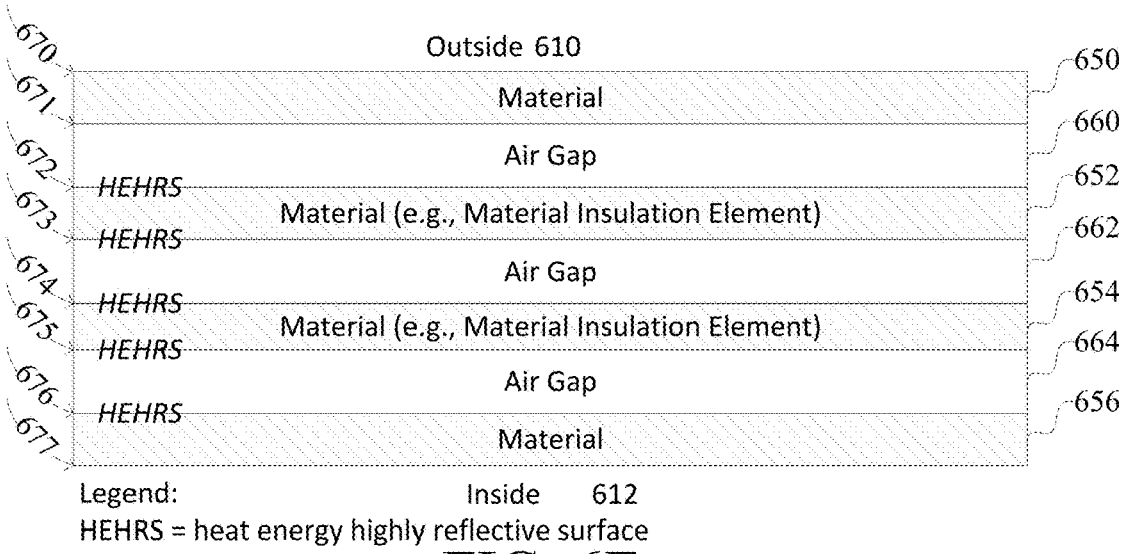

FIGS. 6D and 6E illustrate a first material 650, a second material 652, a third material 654, and a fourth material 656. In some implementations, such materials can be a board such as 0.25 inch (nominally) thick plywood or fiberboard. In some implementations, the first material 650 may form part of or may be an exterior wall, such as sheathing or panel board, such as 0.50 inch (nominally) thick plywood or fiberboard, or 0.25 inch (nominally) thick plywood or fiberboard or hardboard. In some implementations, the first material 650 may be separate from the exterior wall. The first material 650 can be any material described in connection with FIGS. 6A through 6C.

In some implementations, the fourth material 656 may form part of or may be an interior wall, such as a wallboard. In some implementations, the fourth material 656 may be separate from the interior wall. The outside of a building is illustrated at 610; the inside of the building is illustrated at 612, for reference.

In FIGS. 6D and 6E, between the first material 650 and the second material 652 is a first air gap 660 or first enclosed air space. Between the second material 652 and the third material 654 is a second air gap 662 or second enclosed air space. Between the third material 654 and the fourth material 656 is a third air gap 664 or third enclosed air space. In some implementations, this third air gap can be eliminated, leaving a structure similar to that shown in FIGS. 6A-6C.

In FIGS. 6D and 6E, the first material 650 has a first outer surface 670 and a first inner surface 671 opposite the first outer surface. The second material 652 has a first surface 672 and a second surface 673 opposite the first surface. The third material 654 has a third surface 674 and a fourth surface 675 opposite the third surface. The fourth material 656 has a second inner surface 676 and a second outer surface 677 opposite the second inner surface. Thus, the first inner surface 671 and the first surface 672 form enclosed air space 660. The second surface 673 and the third surface 674 form enclosed air space 662. The fourth surface 675 and the second inner surface 676 form enclosed air space 664.

In FIGS. 6D and 6E, on the first material 650, as this material can be any conventional outer wall construction, the first outer surface 670 and first inner surface 671 can be any kind of surface, such as the conventional surface of the conventional material. Similarly, on the fourth material 656, as this material can be any conventional inner wall construction, the second outer surface 677 and second inner surface 676 can be any kind of surface, such as the conventional surface of the conventional material, as shown in FIG. 6D. In FIG. 6E, the second inner surface 676 is shown as having a fifth heat energy highly reflective surface.

In FIGS. 6D and 6E, for the second material 652, both the first surface 672 and the second surface 673 are first and second, respectively, heat energy highly reflective surfaces. For an above grade wall, for the third material 654, both the third surface 674 and the fourth surface 675 are third and fourth, respectively, heat energy highly reflective surfaces. One or both of the second material 652 or third material 654 can be a material insulator.

As described in more detail below, the combination of the second material 652 and third material 654 enclosing an air space 662, with each material 652 and 654 having heat energy reflecting surfaces (672, 673, 674, 675), forms a device which can be inserted into the framing of a variety of different building structures to provide energy efficient management of temperature within a building. In some implementations, such a device can be used as the second material 602 in FIGS. 6A-6C.

Figure 6F:
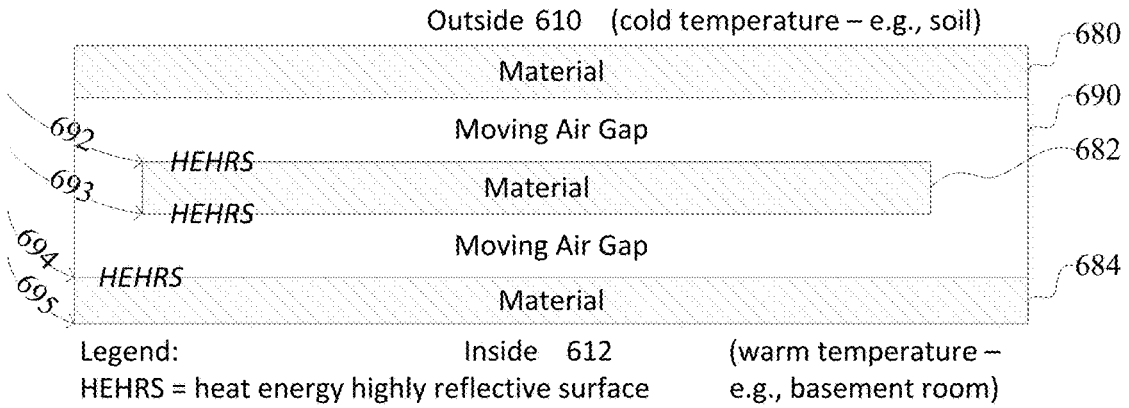

FIG. 6F illustrates an example implementation for a wall construction where heat flow direction is generally the same regardless of the season (winter or summer), such as a below-grade wall, such as in a basement or other subterranean construction. In FIG. 6F, there is a first material 680, a second material 682, and a third material 684. In some implementations, the first material 680 may form part of or may be an exterior wall, such as a concrete or other material foundation. The first material 680 is nearer to a colder temperature, such as the soil. In some implementations, such materials can be a board such as 0.25 inch (nominally) thick plywood or fiberboard. In some implementations, the third material 684 may form part of or may be an interior wall, such as a wallboard. The third material is nearer to a warmer temperature, such as a basement room.

In FIG. 6F, around the second material 682 is an air space 690 within which air can naturally circulate. The second material 682 has a first surface 692 and a second surface 693 opposite the first surface. The third material 684 has a third surface 694 and a fourth surface 695 opposite the third surface. Thus, an inner surface of the first material 680 and the third surface 694 of the third material 684 form the air space 690.

In FIG. 6F, on the first material 680, as this material can be any conventional outer wall construction, its inner surface can be the conventional surface of the conventional material. For the second material 682, both the first surface 692 and the second surface 693 are first and second, respectively, heat energy highly reflective surfaces. Similarly, on the third material 684, as this material can be any conventional inner wall construction, the fourth surface 695 can be any kind of surface, such as the conventional surface of the conventional material. The third surface 694 is shown as having a third heat energy highly reflective surface.

Figure 6G:
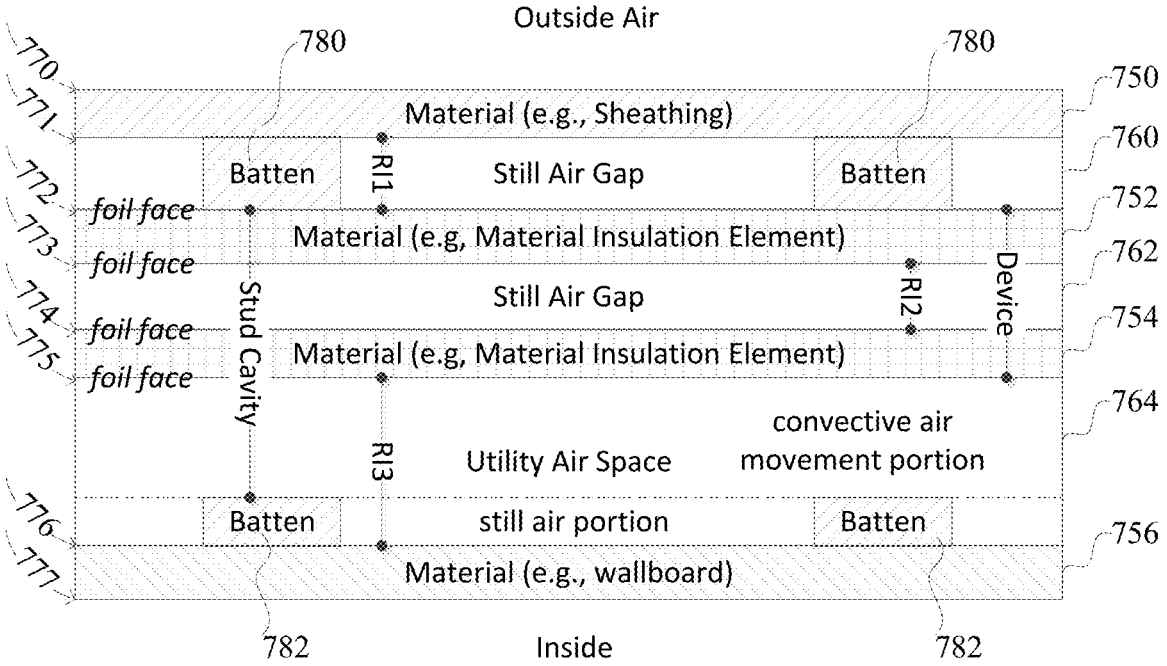

In FIG. 6G, a detailed schematic of an example implementation is shown using a device in a typical 2"×4" (nominal) stud framing with battens of a building. Similar to FIGS. 6D and 6E, in FIG. 6G, a first material 750 has a first outer surface 770 and a first inner surface 771 opposite the first outer surface. A second material 752 has a first surface 772 and a second surface 773 opposite the first surface. A third material 754 has a third surface 774 and a fourth surface 775 opposite the third surface. A fourth material 756 has a second inner surface 776 and a second outer surface 777 opposite the second inner surface.

As in FIGS. 6D and 6E, in the example device shown in FIG. 6G, for the second material 752, both the first surface 772 and the second surface 773 are first and second, respectively, heat energy highly reflective surfaces. For third material 754, both the third surface 774 and the fourth surface 775 are third and fourth, respectively, heat energy highly reflective surfaces.

As described in more detail below, the combination of the second material 752 and third material 754 enclosing an air space 762, with each material 752 and 754 having heat energy highly reflective surfaces (772, 773, 774, 775), forms a device that can be inserted into a wall or other opaque building structure to provide energy efficient climate control. In some uses, this device can be inserted into framing of a wall within a building as shown in FIG. 6G. In this example implementation, the second material 752 and the third material 754 are each illustrated as a material insulator, e.g., an insulating board, such as 0.50 inch (nominally) insulating board. The air gap 762 is about 0.75 inches thick. Thus, the device is about 1.75 inches thick.

In FIG. 6G, the first material 750 can be any conventional outer wall construction such as sheathing or siding. Thus, the first outer surface 770 and first inner surface 771 can be any kind of conventional surface of the conventional outer wall construction. Similarly, the fourth material 756 can be any conventional inner wall construction. Thus, the second outer surface 777 and second inner surface 776 can be any kind of conventional surface of the conventional inner wall construction.

In FIG. 6G, a first plurality of battens 780 are spaced along the inner surface of the outer wall material 750. Similarly, a second plurality of battens 782 are spaced on the inner surface of the inner wall material 756. Some (if not all) of the battens can connect to studs (not shown) that form the walls. With battens 782 that are nominally 0.75 inches thick, and with a typical 2"×4" (nominal) stud framing, which is typically about 3.5 inches thick, the device can be inserted within the stud framing and still provide a utility air space (air gap 764) of a typical size of 2.5 inches.

Also, in FIG. 6G, using the battens 780, the first inner surface 771 and the first surface 772 form an enclosed air space 760. The second surface 773 and the third surface 774 form enclosed air space 762. The fourth surface 775 and the second inner surface 776 form enclosed air space 764. The use of battens also can, without being bound by theory, create a non-convective zone adjacent a surface supported by the battens, and a convective zone away from that surface.

Figure 6H:
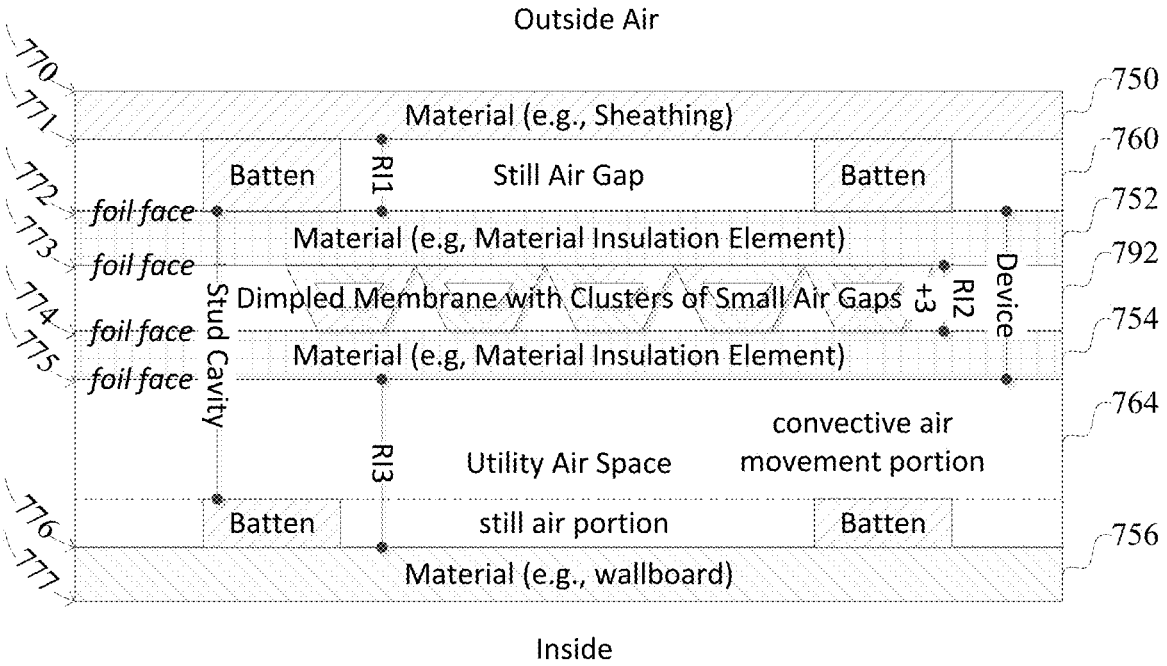

In FIG. 6H, a detailed schematic of an example implementation is shown using another example implementation of a device in a typical 2"×4" (nominal) stud framing with battens of a building. This implementation is otherwise similar to that shown in FIG. 6G, but air gap 792 within the device can be filled with a material, such a dimpled membrane or other material with a cluster of small air gaps. An example of such a dimpled membrane is a high-density polyethylene (HDPE) dimple sheet made by Superseal Construction Products, Ltd. In some implementations, the second material 752 and third material 754 can be made of materials.

Without being bound by theory, an explanation of the terms and presumed mode of operation of such a device within a building construction will now be described.

The term "heat energy highly reflective" layer or surface (HEHRS) refers to a layer on a material or a surface of a material which provides that material with a surface which is highly reflective of heat energy, i.e., the surface emittance of heat energy of less than 0.05. In some implementations the surface emittance is preferably less than or about 0.04. In some implementations the surface emittance is preferably less than or about 0.03. In some implementations, the surface emittance is preferably in a range of about 0.05 to 0.03 (or less), 0.04 to 0.03 (or less). In some implementations, a thin metal foil sheet can be used as a layer applied to a material to provide a heat energy highly reflective surface. An aluminum foil sheet with a surface emittance of 0.03 can be used. Such a surface reflects or blocks most heat energy exchange from another material across an adjacent air space. Other heat energy highly reflective materials can be used, such as certain metals, alloys, compounds, or other materials, and the invention is not limited to use of aluminum foil.

A surface is called a non-reflecting surface when the surface emittance of heat energy is greater than about 0.25. A surface is called reflective when the surface emittance of heat energy is less than about 0.10. A surface that is neither non-reflective nor reflective may be called "fairly reflective" or "partially reflective". Many typical building materials, such wood, plastic, or concrete, have a natural surface which typically is non-reflective of heat energy, with a surface emittance of about 0.90. Similarly, when the surfaces of such materials are painted with conventional paint, the surface typically remains non-reflective of heat energy. Because the surface of the material is non-reflective, most heat energy exchanged across any adjacent material or air space is retained in the receiving material mass.

The term "reflective insulation element" refers to the combination of a confined air space and bounding surfaces of two parallel opaque materials enclosing the air space, when one or both of the bounding surfaces is a heat energy reflecting surface. A "highly reflective insulation element" is a reflective insulation element in which at least one of the enclosing surfaces of the confined air space is a heat energy highly reflective surface. The effective emittance of the reflective insulation element depends on many factors, such as the size and constitution of the air gap, surface emittances of the enclosing surfaces, textures of the surfaces, and other factors, and generally is determined experimentally for any combination. Notably, the effective emittance is substantially lower when at least one heat energy highly reflective surfaces is used and is even lower when both surfaces are heat energy highly reflective surfaces.

Within a confined air space, the material with the heat energy highly reflective surface herein is called a "radiant shield". If a wall assembly space is not confined, and instead is open, then the term "radiant barrier" is used herein, because an equivalent R-value cannot be determined by experimental testing of heat transfer conductivity of an unconfined space.

The term "material insulation element" or "material insulator" means any form of solid material, such as a panel, board, spray foam (when solidified), rigid foam insulation, or other element, where the material is opaque and primarily insulating with respect to heat energy. The material insulation element may have voids. The material insulation element is preferably homogeneous in the direction of heat transfer. Conventionally such materials have a so-called "R-factor" or "R-rating" indicating a measure of its resistance to heat transfer. For these purposes, an R-factor greater than R-3.6 per inch is typically insulating and many products are in the range of R-3 to R-8 per inch.

The term "air space" or "air gap" can be either still air or moving air. With still air, there is little or no convection, and any heat transfer occurs primarily by conduction. With moving air, heat transfer can occur by both convection and conduction.

The term "device" means any combination of materials that, when inserted into a wall construction, forms a sequence of two or more parallel highly reflective insulation elements in the direction of heat flow in combination with a material insulator providing one or more of the heat energy highly reflective surfaces. In some implementations, the device can be any two-sided material element which forms a reflective insulation element on either side of it in a cavity.

In some implementations, the device can include two material insulation elements with an air space in between them. In some implementations, the surfaces enclosing the air space are both heat energy highly reflective surfaces. Any of the foregoing embodiments can be embodied as a device. In some implementations, the device is formed by the placement of layers of material in the specified order and the specified spacing between layers of sheathing and between studs during construction of a wall. In some implementations, the layers of material forming the device are preconstructed into sheets, wherein the specified order and specified spacing of the layers of material is maintained by affixing framing material, such as wood, material insulation, or other rigid construction material, to the layers of material. The framing material can be placed at the edges of the sheet, or at spaced-apart intervals along a sheet. For example, a sheet can be sized to fit a standard distance between a pair of studs or between battens for conventional building construction. During construction of a wall, a sheet can be cut to fit between each pair of studs forming the wall.

A highly reflective insulation element is formed by an air gap and two enclosing parallel surfaces, of which one or both of the surfaces is a heat energy highly reflective surface. Heat energy transfers through the air gap from the surface with the greater heat energy to the other surface with lower heat energy. When the surface with the lower heat energy is a heat energy highly reflective surface, most of that heat energy is reflected back to the other surface. While some heat energy passes through the heat energy highly reflective surface, in the device, that heat energy highly reflective surface is on a material insulator. The material insulator retards transfer of heat energy to its opposite surface. The opposite surface can be one surface of another highly reflective insulation element. A sequence of two or more highly reflective insulation elements in the direction of heat transfer incorporating two or more material insulating elements provides a hybrid material insulating/highly reflective insulating device.

The term "rigid foam insulation" is a kind of material insulation element and refers to a variety of low-density, homogeneous, opaque foam materials. The "Resistance" property or "R-factor" of such materials typically is in the range of R-3.0 per inch to R-8.0 per inch. By way of example only, and not intended to be limiting, such materials include: expanded polystyrene (EPS), typically with R-3.6 per inch to R-4.0 per inch; extruded polystyrene (XPS) typically with R-4.5 to R-5 per inch, and polyisocyanurate (polyiso) typically with R-7.0 per inch to R-8.0 per inch. When a heat energy highly reflective layer is applied to a surface of a panel of rigid foam insulation panel, the layer provides the panel with a heat energy highly reflective surface. The surface of the rigid foam insulation panel forms a radiant shield to any adjacent confined air space that surface faces in a highly reflective insulation element.

Thus, without being bound by theory, having two or more enclosed air gaps in combination with heat energy highly reflective surfaces on materials adjacent those air gaps, examples of which are shown in FIGS. 6A through 6G, provides efficient heating and cooling of living space enclosed by such construction. When conductive heat flow through the walls is in different directions in winter and summer, for example in above-grade wall assemblies in temperate climates such as shown in FIG. 6D, 6E, 6G, or 6H, three enclosed air gaps with four heat energy highly reflective surfaces across air gaps provides efficient radiant heating and cooling of the living space enclosed by such construction. When conductive heat flow through the walls is in the same direction in both winter and summer, such as in a basement wall assembly as shown in FIG. 6F, two enclosed air gaps with three heat energy highly reflective surfaces across air gaps provides efficient radiant heating and cooling of the living space enclosed by such construction.

In the examples above, without being bound by theory, FIG. 6D is a two-season system for a moderate climate, which has a four stages of radiant shields. FIG. 6E has 5-stages of radiant shields which, with radiant shields with 0.03 emittance, block near 100% of the heat energy transmission in the stud space, when heat flow path is inbound from the exterior to the interior. The inner wallboard material surface thus remains closer to the room air temperature set by a cooling system, and thus would be preferable for very hot summer climates. FIG. 6F has three stages of radiant shields and is suitable for moderate winters and basements.

Further example implementations are shown in FIGS. 1 through 5, which can be made using any of the structures shown in FIGS. 6D through 6G. Similar implementations using the structures of FIGS. 6A through 6C also can be used. In these examples, the mechanically ventilated air spaces can be eliminated in some constructions. In some of these examples, without being bound by theory, predicted R-values of the materials and spaces, and corresponding emittance ("e"-values herein) of the surfaces are provided in the Figures. In these Figures, the annotation of an HEHRS as a "foil face", and in the description any reference to a foil face, or foil-backed material or surface, is merely illustrative of one example implementation and is not intended to be limited.

In FIG. 1, the first material 100 can be a 0.625 inch (nominal) thick sheathing, such as plywood. A 0.75-inch-thick air gap 101 is formed between the sheathing and a material insulation element 102, e.g., a closed-cell foam rigid board insulation. In this example, the material insulation element has a 0.5-inch nominal thickness. The material insulation element is the second material which has a foil face on each surface, one facing air space 101 and another facing air space 103. A 0.75-inch-thick air gap 103 is formed between the material insulation element 102 and anther material insulation element 104, e.g., a closed-cell foam rigid board insulation. In this example, the material insulation element 104 also has a 0.5-inch nominal thickness. The material insulation element 104 is a third material which has a foil face on each surface, one facing air space 103 and another facing air space 105. A fourth material 106 is a wallboard which also can be foil faced. In this example, the wallboard has a nominal 0.625-inch thickness and forms the air space 105, which can be used as a utility air space between the wallboard and the insulation 104. This construction can be used with conventional 2.0 inch by 4.0-inch (nominal) wood wall stud framing which provides about a 3.5-inch-thick stud cavity, where the sheathing and the wallboard (optionally with a spacer or batten) are attached to the interior and exterior sides of the studs. Siding 110 can be applied to the sheathing, optionally leaving a ventilated air space 112, optionally mechanically ventilated, with an example spacing of 1.5 inches. Preferably, the foil faced surfaces are all heat energy highly reflective surfaces, such as by having a thin layer of aluminum foil.

Figure 2:
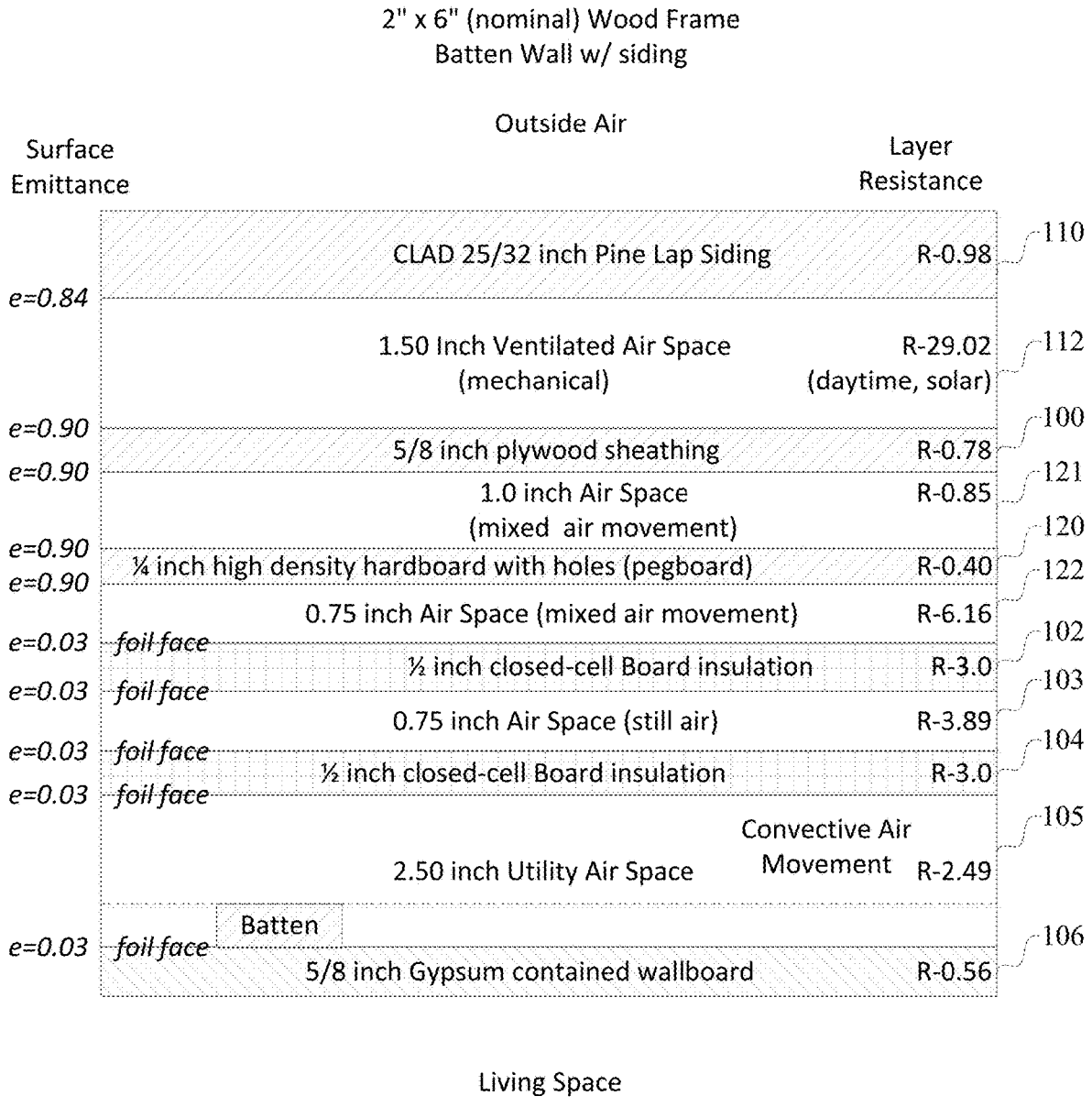
FIG. 2 is a schematic drawing of another example implementation of a wall structure.

FIG. 2 is similar to FIG. 1, but with an additional air space. This construction can be used with conventional 2.0 inch by 6.0-inch (nominal) wood wall stud framing which provides about a 5.5-inch-thick stud cavity, where the sheathing and the wallboard (optionally with a spacer or batten) are attached to the interior and exterior sides of the studs. In this example, material insulation 102 and 104 can be 0.5 inch (nominal) thick closed cell board insulation, with foil faces on both surfaces. In this example, a perforated hardboard panel 120, such as a commercially available 0.25 inch (nominal) thick pegboard, is provided within a larger air space to divide the air space into a first air space 121 and a second air space 122, allowing mixed air movement between air spaces 121 and 122, and in addition the creation of a temporary thermal mass heat sink during hot summer climate conditions.

Figure 3:
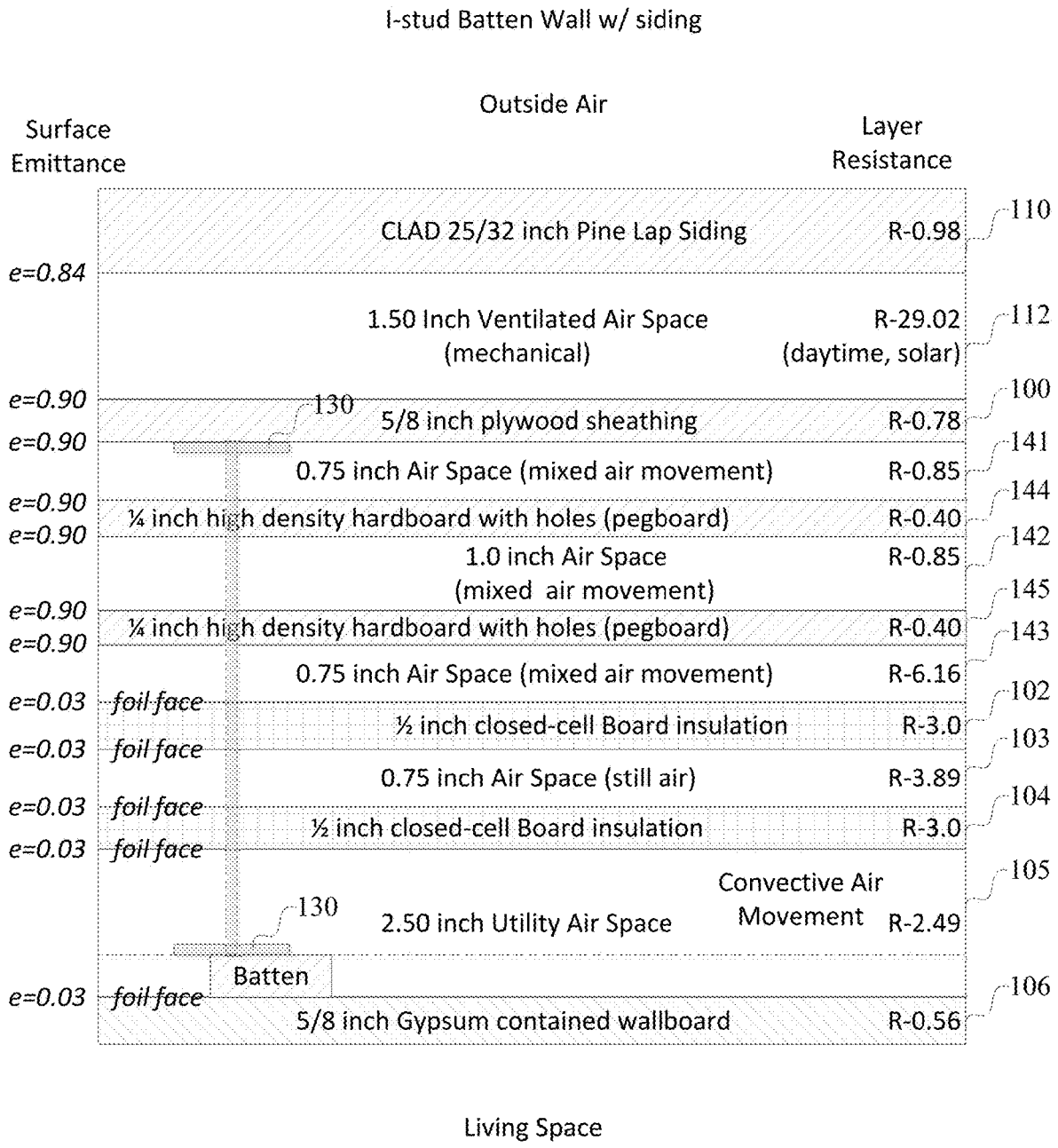
FIG. 3 is a schematic drawing of another example implementation of a wall structure.

FIG. 3 is similar to FIGS. 1 and 2 but has a different set of air spaces. This construction can be used with a 2.0 inch by 6.0-inch (nominal) wood wall stud framing with a 1.0 inch thick (nominal) by 6.0-inch-wide flange 130 attached to the interior and exterior surfaces of the studs which provides about a 7.0-inch-thick stud cavity. The sheathing and the wallboard (optionally with a spacer or batten) are attached to the interior and exterior sides of the flanges. In this example the material insulation 102 and 104 also has a 0.5-inch nominal thickness. A larger air space is separated into air spaces 141, 142, and 143 by two perforated boards 144, 145 between the foil-backed material insulation 102 and the sheathing 100. In this example, the perforated boards can be 0.25-inch nominal thickness high density hardboard.

In FIGS. 2 and 3, the mixed air movement around a pegboard in an air space balances the temperature and pressure between the different portions of the air space on opposing sides of the pegboard. This air space and the pegboard in it can act as a heat sink, which can be particularly useful in environments where heat gain due to solar energy on the exterior of the building structure is high.

Figure 4A:
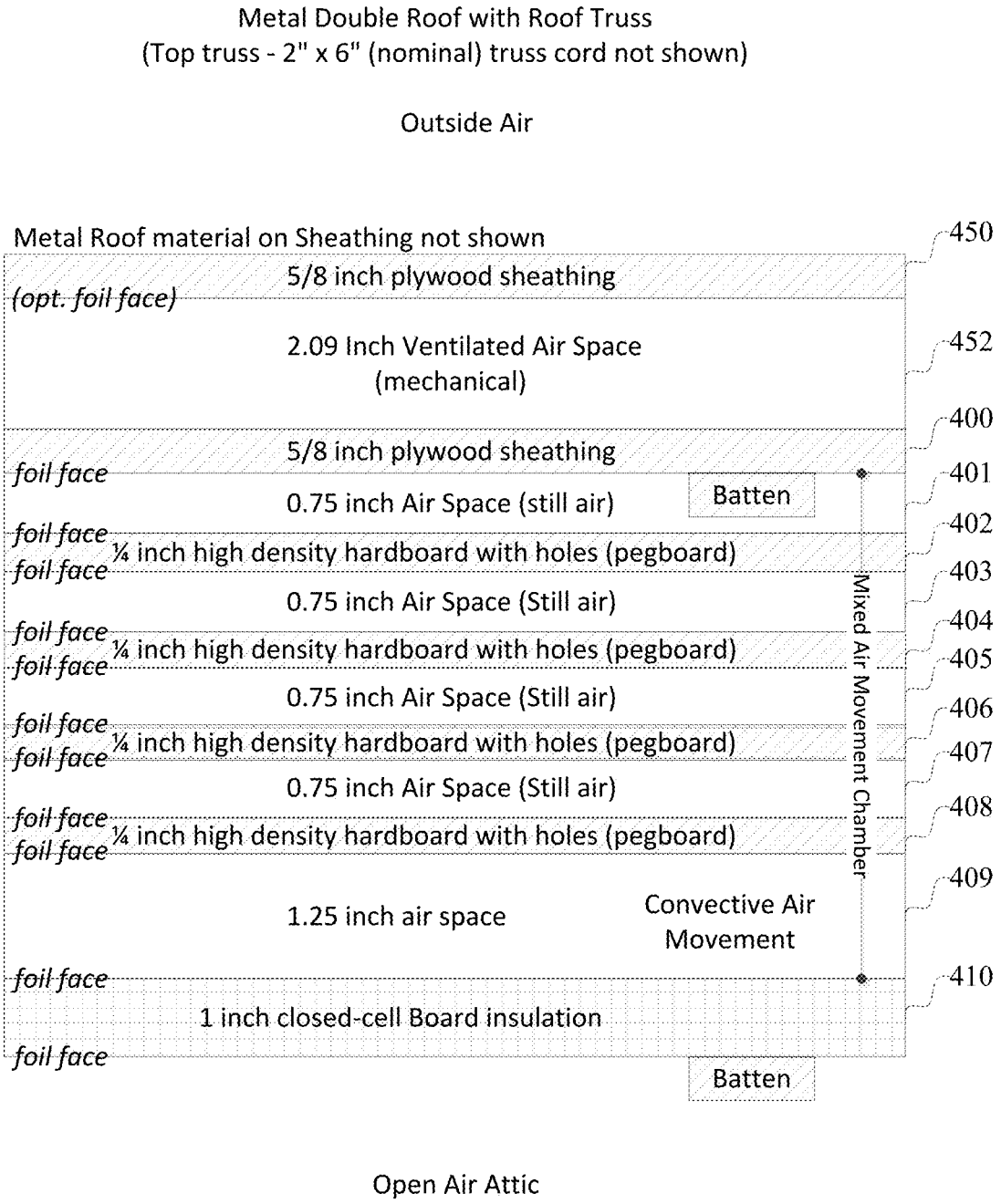
FIG. 4A is a schematic drawing of another example implementation of a building structure including a roof truss.

FIG. 4A includes an example construction for supporting a roof, in this example a metal double roof. In this example, a 2.0-inch by 6.0-inch (nominal) wood top cord (not shown) is attached between the interior wall and the exterior sheathing. In this example, between the interior wall and the exterior sheathing are five foil-enclosed air spaces. A sheathing 400 can be foil-faced on the interior surface. Four of the air spaces (401, 403, 405, 407) are approximately 0.75 inches, separated by 0.25 (nominal) thickness materials (402, 404, 406, 408), e.g., a high-density hardboard, each of which can be foil-backed on one or both surfaces. The interior-most material is a material insulation element 410, e.g., closed-cell foam rigid board, having both sides with foil facings. Convective air movement can be provided in the air space 409 between material insulation 410 and hardboard 408 A ventilated air space 452 can be provided between sheathing 450 supporting the upper slope roof and the sheathing 400 attached to the house truss structure. This sheathing 450 also can have a foil backing.

Figure 4B:
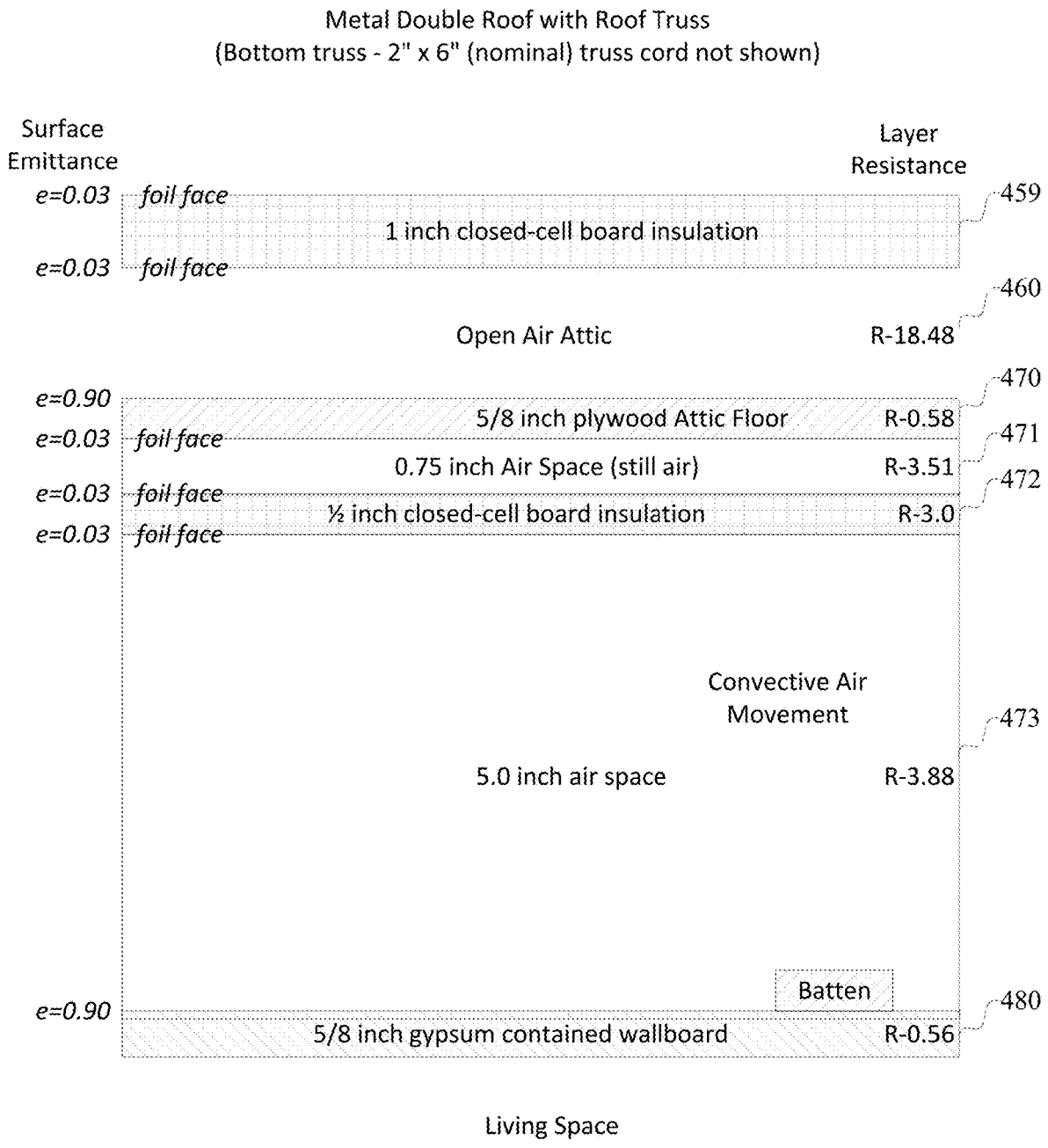
FIG. 4B is a schematic drawing of another example implementation of a building structure including an attic.

In FIG. 4B, the attic space 460 beneath the roof structure shown in FIG. 4A, as exemplified at 459, is a variable wide air space above an attic floor, which includes a subfloor. Beneath the subfloor, and above the ceiling in the living space below, also can include foil-backed materials forming foil-enclosed air spaces. In this example, the floor joists are 2.0 inch by 6.0-inch (nominal) wood planks to which the attic subfloor 470 is attached above, and to which wallboard 480 or other ceiling material is connected below, optionally with a spacer or batten. The ceiling material has a foil-backed surface. Within the space between the subfloor and the ceiling is formed at least two air spaces 471 and 473. A first air space 473 is foil-enclosed between a material insulation element 472 that is foil backed and the ceiling material. The second air space 471 is between the subfloor 470 and the other foil-backed surface of the material insulation element 472.

Figure 5:
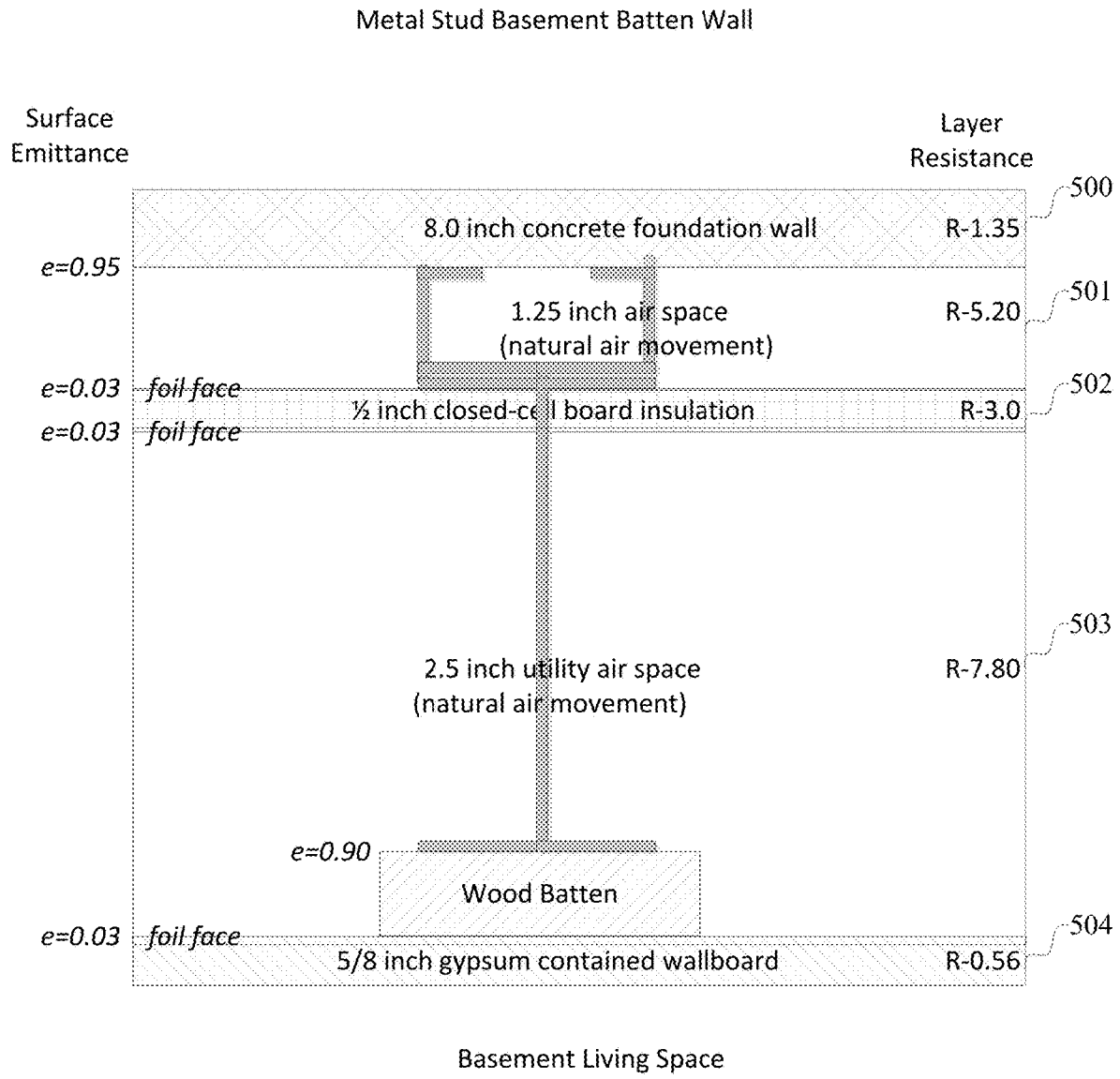
FIG. 5 is a schematic drawing of another example implementation of a building structure including a basement wall.

FIG. 5 is an example construction that can be used with a concrete foundation wall and metal studs to support an interior wall structure finishing the concrete wall. In this example, material insulation element 502, e.g., a closed-cell board, which has two foil-backed surfaces forms an air space 501 with the concrete foundation 500 on one side, and a foil-enclosed air space 503 with a foil-backed wallboard 504 on the other side. The second air space is formed around the metal studs and is formed with bottom and top open slots to allow natural air movement flow.

In these various examples, without being bound by theory, energy efficiency is provided because two or more air spaces are enclosed by surfaces of which at least one is provided by a radiant shield or is a heat energy highly reflective surface, which forms a highly reflective insulation element. The surfaces with the heat energy highly reflective material reflect or block transfer of most of the heat energy that hits them and allows a minimum amount of heat energy to pass through them into the materials behind those surfaces (such as a wood board or insulator board). Thus, heat energy between the two surfaces in an air space tends to remain captured in that air space. The temperature of the receiving surface elevates, while the temperature of the sending surface reduces, but at different rates, until an equilibrium is reached. When the air space is still, at approximately 0.75 inches maximum thickness, this heat energy exchange is mostly conductive and not convective. Energy efficiency is maximized when at least one of the radiant shields or heat energy highly reflective surfaces reflects about 97% or more of the heat energy that hits it.

In some implementations, the first enclosed air space can have a thickness of about 0.75 inches. The second enclosed air space can have a thickness of about 0.75 inches. A third enclosed air space can have a thickness of about 1.50 inches to 2.50 inches and act as a utility air space. The first, second, and third materials can be of similar construction, such as 0.25-inch-thick wood boards.

In some implementations, when a sheathing is attached to an outer surface of the studs, the sheathing and the outer surface of the first material form an outer air space. When a wallboard is attached to an inner surface of the studs, the wallboard and the inner surface of the third material form a utility air space. The outer air space can have a thickness in the range of about 1.0 inches to 1.5 inches. The utility air space has a thickness in the range of about 3.0 inches to about 4.0 inches.

In some implementations, a device can include two material insulation elements with an enclosed air gap between them of about 0.75 inches, and with each material insulation element having both surfaces with a heat energy highly reflective surface, preferably and aluminum foil with an emissivity of about 0.03. The material insulation elements can be made of rigid foam board insulation and can be about 0.5 inches thick, making the device about 1.75 inches thick. Without being bound by theory, such a device produces four 97% heat block events in series through the heat energy highly reflective surfaces, and the material insulation elements provide a thermal mass that stores heat energy between highly reflective insulation elements.

Generally, the material insulation element has a thickness between 0.25 inches and 1.0 inches, depending on the material. The material can be, for example, plywood, hardboard, closed-cell board, open-cell board, rigid foam insulation, or yes other materials. Example commercially available materials include but are not limited to Polyiso board, closed-cell rigid foam board, Plascore polypropylene honeycomb board (closed-cell), Plascore polypropylene honeycomb board (open-cell). Any such materials can be manufactured as foil-backed, i.e., to have a heat energy highly reflective surface, or a layer can be applied to a surface of the material to provide the heat energy highly reflective surface.

It should be understood that the subject matter defined in the appended claims is not necessarily limited to the specific implementations described above. The specific implementations described above are disclosed as examples only.

What is claimed is:

1. A device for use in an opaque building structure, comprising:

a first rigid material insulation element having a first face and a second face and opposite the first, wherein the first face supports a first heat energy highly reflective surface, and wherein the second face supports a second heat energy highly reflective surface, wherein the first rigid material insulation element comprises a primarily insulating material with a thickness between 0.25 inches and 1.0 inches; and a second rigid material insulation element having a third face and a fourth face opposite the third face, wherein the third face supports a third heat energy highly reflective surface, and wherein the fourth face supports a fourth heat energy highly reflective surface, wherein the second rigid material insulation element comprises a primarily insulating material with a thickness between 0.25 inches and 1.0 inches; and wherein the first rigid material insulation element and the second rigid material insulation element are connected with the second heat energy highly reflective surface parallel to the third heat energy highly reflective surface to form an air space of still air between the second heat energy highly reflective surface and the third heat energy highly reflective surface, whereby the air space, the second heat energy highly reflective surface, and the third heat energy highly reflective surface form a highly reflective insulation element.

2. The device of claim 1, wherein each of the first and second rigid material insulation elements comprises rigid foam board insulation.

3. The device of claim 1, wherein each of the first, second, and third heat energy highly reflective surfaces comprises a respective layer of aluminum foil.

4. The device of claim 1, wherein each of the first, second, and third heat energy highly reflective surfaces has an emittance of less than or equal to 0.05.

5. The device of claim 1, wherein each of the first, second, and third heat energy highly reflective surfaces has an emittance of less than or equal to 0.04.

6. The device of claim 1, wherein each of the first, second, and third heat energy highly reflective surfaces has an emittance of about 0.03.

7. The device of claim 1, wherein each of the first and second rigid material insulation elements has a resistance factor of at least R-3.6 per inch.

8. The device of claim 1, wherein each of the first and second rigid material insulation elements has a resistance factor in the range of R-3.0 per inch to R-8.0 per inch.

9. The device of claim 1, wherein:

the first rigid material insulation element comprises an insulation element having a resistance factor in the range of R-3.0 per inch to R-8.0 per inch;

the first heat energy highly reflective surface has an emittance of less than or equal to 0.05;

the second heat energy highly reflective surface has an emittance of less than or equal to 0.05;

the second rigid material insulation element comprises an insulation element having a resistance factor in the range of R-3.0 per inch to R-8.0 per inch;

the third heat energy highly reflective surface has an emittance of less than or equal to 0.05;

the fourth heat energy highly reflective surface comprises has an emittance of less than or equal to 0.05; and wherein a width of the air space is about 0.75 inches.

10. A device for use in an opaque building structure, configured for installation in a space between exterior sheathing defining an exterior inner surface in the opaque building structure and an interior wallboard defining an interior inner surface in the opaque building structure to form a tandem series of highly reflective insulation elements within the space, the device comprising:

a first rigid material insulation element having a first face supporting a first heat energy highly reflective surface and having a second face supporting a second heat energy highly reflective surface, wherein the first rigid material insulation element comprises a primarily insulating material with a thickness between 0.25 inches and 1.0 inches; and a second rigid material insulation element having a third face supporting a third heat energy highly reflective surface in parallel with and forming a first air space of still air with the second heat energy highly reflective surface, wherein the second rigid material insulation element comprises a primarily insulating material with a thickness between 0.25 inches and 1.0 inches;

wherein the first air space, the second heat energy highly reflective surface, and the third heat energy highly reflective surface form a first highly reflective insulation element; and wherein, when the device is installed in the space with the first heat energy highly reflective surface parallel with and facing the exterior inner surface and forming a second air space of still air between the first heat energy highly reflective surface and the exterior inner surface, the second air space, the first heat energy highly reflective surface, and the exterior inner surface form a second highly reflective insulation element.

11. The device of claim 10, wherein the second rigid material insulation element has a fourth face opposite the third face, and wherein the fourth face supports a fourth heat energy highly reflective surface.

12. The device of claim 11, wherein:

the first rigid material insulation element comprises an insulation element having a resistance factor in the range of R-3.0 per inch to R-8.0 per inch;

the first heat energy highly reflective surface has an emittance of less than or equal to 0.05;

the second heat energy highly reflective surface has an emittance of less than or equal to 0.05;

the second rigid material insulation element comprises an insulation element having a resistance factor in the range of R-3.0 per inch to R-8.0 per inch;

the third heat energy highly reflective surface has an emittance of less than or equal to 0.05;

the fourth heat energy highly reflective surface comprises has an emittance of less than or equal to 0.05; and wherein a width of the second air space between the second pair of parallel surface is about 0.75 inches.

13. The device of claim 10, wherein each of the first and second rigid material insulation elements comprises rigid foam board insulation.

14. The device of claim 10, wherein each of the first and second rigid material insulation elements has a resistance factor in the range of R-3.0 per inch to R-8.0 per inch.

15. The device of claim 10, wherein each of the first and second rigid material insulation elements has a resistance factor of greater than about R-3.6 per inch.

16. The device of claim 10, wherein each of the first, second, and third heat energy highly reflective surfaces comprises a respective layer of aluminum foil.

17. The device of claim 10, wherein each of the first, second, and third heat energy highly reflective surfaces has an emittance of less than or equal to 0.05.

18. The device of claim 10, wherein each of the first, second, and third heat energy highly reflective surfaces has an emittance of less than or equal to 0.04.

19. The device of claim 10, wherein each of the first, second, and third heat energy highly reflective surfaces has an emittance of about 0.03.

20. A device for use in a building structure, comprising:

a first opaque rigid material insulation element having a first face supporting a first heat energy highly reflective surface and having a second face supporting a second heat energy highly reflective surface, wherein the first opaque rigid material insulation element comprises a primarily insulating material with a thickness between 0.25 inches and 1.0 inches; and a second opaque rigid material insulation element having a third face supporting a third heat energy highly reflective surface in parallel with and forming an air space of still air with the second heat energy highly reflective surface, wherein the second opaque rigid material insulation element comprises a primarily insulating material with a thickness between 0.25 inches and 1.0 inches;

wherein the air space, the second heat energy highly reflective surface, and the third heat energy highly reflective surface form a highly reflective insulation element.

* * * * *